US010149990B2

(12) United States Patent
Schuler et al.

(10) Patent No.: US 10,149,990 B2
(45) Date of Patent: Dec. 11, 2018

(54) PORTABLE, LIGHT-WEIGHT OXYGEN-GENERATING BREATHING APPARATUS

(71) Applicant: SOTERIA TECHNOLOGIES, Lindenhurst, NY (US)

(72) Inventors: Scott Schuler, Ronkonkoma, NY (US); Mel Blum, Wantagh, NY (US); Jeff Peterson, Huntington, NY (US)

(73) Assignee: SOTERIA TECHNOLOGIES LLC, Lindenhurst, NY (US)

( * ) Notice: Subject to any disclaimer, the term of this patent is extended or adjusted under 35 U.S.C. 154(b) by 0 days.

(21) Appl. No.: 15/355,905

(22) Filed: Nov. 18, 2016

(65) Prior Publication Data

US 2018/0140874 A1 May 24, 2018

(51) Int. Cl.
*A62B 21/00* (2006.01)
*A62B 7/08* (2006.01)
(Continued)

(52) U.S. Cl.
CPC ..... *A62B 21/00* (2013.01); *A62B 7/08* (2013.01); *A62B 9/02* (2013.01); *A62B 9/06* (2013.01)

(58) Field of Classification Search
CPC .. A62B 21/00; A62B 9/02; A62B 9/04; A62B 9/06; A62B 7/08; A61M 16/0045
See application file for complete search history.

(56) References Cited

U.S. PATENT DOCUMENTS 3,575,167 A * 4/1971 Michielsen ..... A62B 7/10 128/200.24
3,767,367 A 10/1973 Rio
(Continued)

FOREIGN PATENT DOCUMENTS

CN 202140113 U 2/2012
CN 103405861 A 11/2013
(Continued)

OTHER PUBLICATIONS

Kevin R. Ward, et al. "Chemical Oxygen Generation", Respiratory Care, Jan. 2013, vol. 58., No. 1, pp. 184-195.
(Continued)

*Primary Examiner* — Timothy Stanis
(74) *Attorney, Agent, or Firm* — Oliff PLC

(57) ABSTRACT

A portable oxygen-generating breathing apparatus comprising a user interface configured to receive an exhalation air stream from and supply a breathable inhalation air stream to a user, a reaction chamber configured to house a reaction composition that reacts with the exhalation air stream in order to convert the exhalation air stream into the breathable inhalation air stream, an inflatable member configured to receive the breathable inhalation air stream from the reaction chamber, and an interface junction disposed between the user interface and the reaction chamber in a flow direction of the exhalation air stream and between the inflatable member and the user interface in a flow direction of the breathable inhalation air stream, the interface junction having an exhale valve to allow the flow of the exhalation air stream and an inhale valve to allow the flow of the breathable inhalation air stream one-directionally.

35 Claims, 23 Drawing Sheets

(51) Int. Cl.
*A62B 9/02* (2006.01)
*A62B 9/06* (2006.01)

(56) References Cited

U.S. PATENT DOCUMENTS

| | | | | | |
|---|---|---|---|---|---|
| 3,860,396 | A | | 1/1975 | Finley | |
| 3,938,512 | A | | 2/1976 | Mausteller et al. | |
| 3,942,524 | A | | 3/1976 | Li et al. | |
| 4,019,509 | A | | 4/1977 | Li et al. | |
| 4,325,364 | A | | 4/1982 | Evans | |
| 4,409,978 | A | * | 10/1983 | Bartos | A62B 7/10 128/202.26 |
| 4,731,197 | A | | 3/1988 | Eckstein et al. | |
| 4,781,184 | A | * | 11/1988 | Fife | A62B 7/10 128/205.12 |
| 4,963,327 | A | | 10/1990 | Russell | |
| 5,198,147 | A | | 3/1993 | Zhang et al. | |
| 5,222,479 | A | | 6/1993 | Brauer et al. | |
| 5,267,558 | A | | 12/1993 | Haertle et al. | |
| 5,620,664 | A | | 4/1997 | Palmer | |
| 5,690,099 | A | | 11/1997 | Abramov et al. | |
| 5,750,077 | A | * | 5/1998 | Schoen | A62B 21/00 422/122 |
| 7,513,251 | B2 | | 4/2009 | Blum | |
| 8,147,760 | B1 | | 4/2012 | Huvard et al. | |
| 8,230,854 | B2 | | 7/2012 | Kruger et al. | |
| 8,919,340 | B2 | | 12/2014 | Blum | |
| 2007/0215159 | A1 | | 9/2007 | Ross et al. | |
| 2011/0277768 | A1 | | 11/2011 | Hill et al. | |
| 2013/0167840 | A1 | * | 7/2013 | Monzyk | A62B 7/08 128/202.26 |
| 2013/0247908 | A1 | * | 9/2013 | Blum | A62B 7/08 128/202.26 |
| 2014/0248195 | A1 | * | 9/2014 | Vigier | A62B 7/08 422/240 |

FOREIGN PATENT DOCUMENTS

| | | | |
|---|---|---|---|
| CN | 103706053 | A | 4/2014 |
| CN | 204170306 | U | 2/2015 |
| DE | 1925948 | A1 | 11/1970 |
| EP | 0171458 | A1 | 2/1986 |
| EP | 0172265 | A1 | 2/1986 |
| EP | 1688163 | A1 | 8/2006 |
| FR | 2192865 | A1 | 2/1974 |
| GB | 751033 | A | 6/1956 |
| GB | 2 181 655 | A | 4/1987 |
| WO | 2013/089690 | A1 | 6/2013 |

OTHER PUBLICATIONS

Peter C. Wood, et al., "Improved Oxygen Sources for Breathing Apparatus", NASA Technical Memorandum 86671, May 1985.

* cited by examiner

Figure 21A
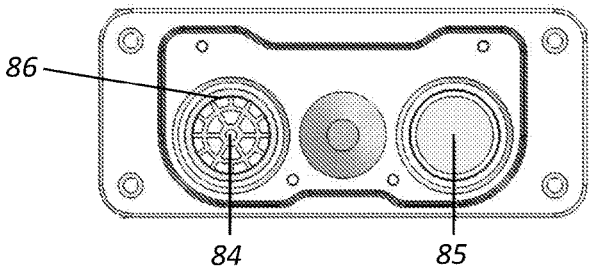
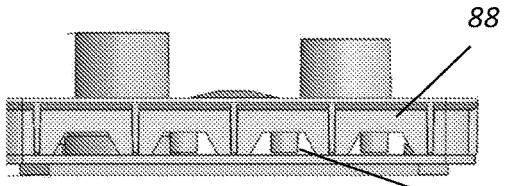
Figure 21B
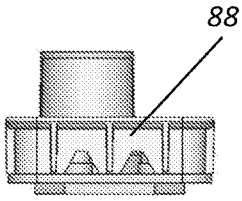
Figure 21C
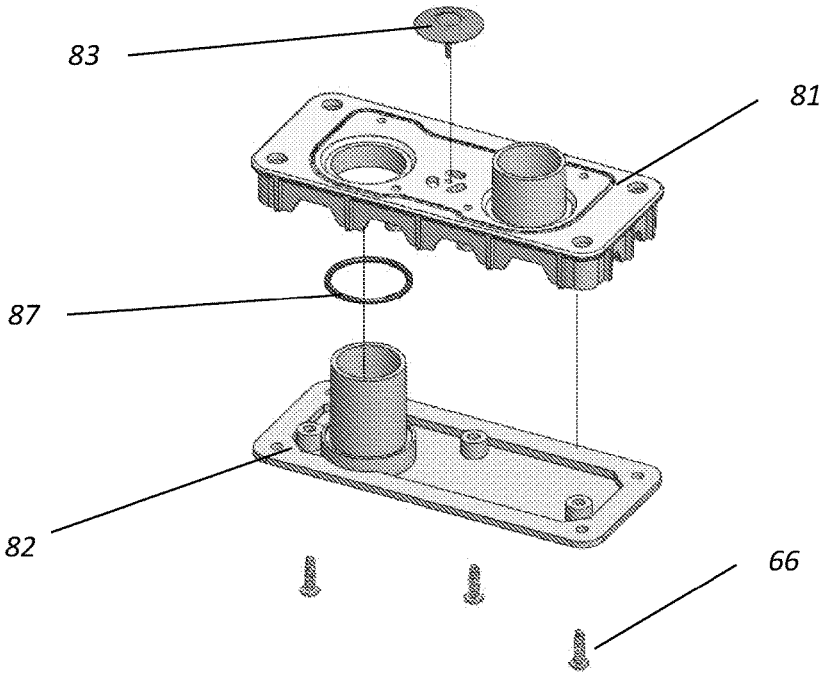
Figure 22

PORTABLE, LIGHT-WEIGHT OXYGEN-GENERATING BREATHING APPARATUS

TECHNICAL FIELD

This application relates to a portable, light-weight oxygen-generating breathing apparatus and systems and methods for providing oxygen generation through a chemical reaction.

BACKGROUND

Emergency breathing apparatuses that provide oxygen to the user are known. Some provide oxygen directly, such as those that use compressed or liquid oxygen. Others provide oxygen through a chemical reaction. Conventional chemical oxygen generators may contain alkali metal chlorate candles, which are burned to produce oxygen. Other conventional chemical oxygen generators may contain potassium superoxide, which reacts with carbon dioxide to produce oxygen.

For example, U.S. Pat. No. 5,690,099 discloses a closed-circuit breathing system that includes a mask and a canister containing, for example, $KO_2$. The canister contains one or more working compounds formed of a peroxide and/or superoxide of one or more metals of the alkali and alkaline-earth metal groups, such as $KO_2$ and $CaO_2$, and a moisture releasing material, such as wetted activated charcoal, is used to replenish the oxygen and absorb the carbon dioxide in exhaled air. The canister includes an inlet port for receiving exhaled air, and an outlet port for providing breathable air for inhalation. The patent describes that the canister can be used in a closed or semi-closed circuit breathing system worn by a user such as a fireman, miner, etc.

U.S. Pat. No. 3,938,512 discloses an emergency breathing apparatus that includes a mask having a breathing opening, directly in front of the outer end of which there is a chemical cartridge that is secured to the mask. The cartridge has an exhalation passage extending through it from front to back, with its rear end registering with the breathing opening. A check valve in the inhalation passage allows air flow only into the mask. In the exhalation passage there is a carbon dioxide removing and oxygen generating chemical. A breathing bag is supported by the cartridge and communicates with the front end of the exhalation passage. The mask is provided with an inhalation check valve allowing air being inhaled from the bag to bypass the chemical.

U.S. Pat. No. 5,267,558 discloses a chemical cartridge for respirators, the cartridge containing a chemical, e.g., potassium hyperoxide, which when acted upon by carbon dioxide and moisture, produces oxygen from a stream of inhaled air. Two discharge nozzles are provided that project into the chemical and out of which the regenerated exhaled air flows. The incoming flow occurs over a large area and the outflow occurs over a small area with the peripheral surfaces of the discharge nozzles being spaced substantially equidistant from an inlet surface of the chemical, thereby ensuring optimum use of the chemical for oxygen production purposes because a user's exhaled air is caused to flow completely through the entire space occupied by the chemical.

U.S. Pat. No. 3,942,524 discloses an emergency breathing apparatus that includes a canister containing layers of $KO_2$ particles separated by parallel screen assemblies, the upper two screen assemblies being connected by a vertical bypass screen near the canister inlet. The layered $KO_2$ bed removes $CO_2$ from exhaled breath, and generates oxygen for recharging the air prior to inhalation. The canister inlet is connected by a flexible hose to the exhalation side of a breather mouthpiece, the inhalation side of the mouthpiece being connected to the upper end of the inhalation chimney. Communication between the canister outlet and the lower end of the inhalation chimney is provided by a breather bag, fitted with a set of baffles to define a tortuous flow path for cooling the processed air. A collector mounted at the canister outlet prevents liquid $KO_2$ (which forms KOH) from entering the breather bag. To protect the user and confine the heat within the canister, the canister is insulated.

U.S. Pat. No. 3,860,396 discloses a light-weight, portable oxygen generator containing an alkali metal chlorate candle. The generator includes a generally tubular housing, preferably formed of extruded aluminum or other heat-conducting metal, and preferably includes longitudinally-extending ribs which serve to dissipate heat generated inside of the housing. The generator also includes a dispensing valve through which oxygen passes.

U.S. Pat. No. 4,325,364 discloses a training breathing apparatus that includes a disposable canister filled with a reagent that creates heat by reacting with the moisture in exhaled breath.

U.S. Pat. No. 5,620,664 discloses a light-weight, personal, portable oxygen dispenser that includes a cylindrical body. The cylindrical body is a light-weight material, such as extrudable aluminum, with a fluted or ridged exterior configuration to minimize heat conductivity to the fingers of someone holding the dispenser while it is operating.

U.S. Pat. No. 7,513,251 discloses a potassium superoxide oxygen apparatuses in which the oxygen reaction is slowed down to decrease heat generation, thereby allowing the apparatus to be hand-held. Such hand-held generators may be used by, for example, people escaping fires, skiers, mountain climbers, asthmatics, people with emphysema, people suffering from altitude sickness, and athletes. Such hand-held generators may be also used as backup oxygen generators for Emergency Medical Service (EMS) squads, fire departments, miners, and the like, should their regular emergency oxygen become depleted.

U.S. Pat. No. 8,919,340 discloses a potassium superoxide oxygen apparatus comprising a filter that prevents particles having a diameter of 10 μm from passing through the filter, and neutralizes KOH and $KO_2$ particles having a diameter of less than 10 μm that contact the filter into a food grade compound.

SUMMARY

Despite these various designs, conventional portable oxygen generators pose substantial drawbacks that either limit their use, or limit their use by a wide range of individuals that otherwise could benefit from their use. Existing emergency breathing apparatuses tend to be either too heavy, too expensive, or require specialized training to use. As well, they typically require oxygen candles, which can be costly and dangerous, to initially charge the system with oxygen and reduce the percentage of carbon dioxide gas. The present disclosure thus seeks to overcome these disadvantages, and provides improved portable oxygen generation.

For example, disclosed embodiments reduce the use of heavy, expensive and complex materials and are constructed of lightweight plastics and high-temperature-resistant polymer materials that reduce heat transfer and eliminate the need for special insulation. Disclosed embodiments contain an oxygen-generating chemical reaction, direct exhaled air through the chemical and direct the oxygenated air to a user in a controlled one-directional flow to avoid reflux of harmful $CO_2$ and other exhalants to the user during use. Furthermore, in embodiments, exhale and inhale valves are arranged close to the user interface in order to reduce the amount of $CO_2$ reflux and comply with applicable NIOSH regulations governing respirators. According to embodiments, separate exhale and inhale tubes may also be included as part of the interface junction, allowing for the reaction chamber to be moved away from the face and be placed on the chest or back, such that larger amounts of oxygen generating chemical can be used. The user-friendliness of the disclosed embodiments also makes it useful to persons without intensive specialized training.

In a first embodiment, there is provided a portable oxygen-generating breathing apparatus. The apparatus comprises a user interface configured to receive an exhalation air stream from and supply a breathable inhalation air stream to a user, a reaction chamber configured to house a reaction composition that reacts with the exhalation air stream in order to convert the exhalation air stream into the breathable inhalation air stream, an inflatable member in fluid communication with the reaction chamber and configured to receive the breathable inhalation air stream from the reaction chamber, and an interface junction disposed between the user interface and the reaction chamber in a flow direction of the exhalation air stream and between the inflatable member and the user interface in a flow direction of the breathable inhalation air stream, the interface junction having an exhale valve configured to allow the flow of the exhalation air stream one-directionally from the user interface to the reaction chamber and an inhale valve configured to allow the flow of the breathable inhalation air stream one-directionally from the inflatable member to the user interface.

The inflatable member may be connected in series with the reaction chamber downstream of the reaction chamber.

The inflatable member may be disposed around and enclose the reaction chamber in an airtight seal.

The apparatus may further comprise a manifold disposed between the interface junction and the reaction chamber, and in communication with the inflatable member. The manifold may be configured to separate the flow of the exhalation air stream between the interface junction and the reaction chamber and the flow of the inhalation air stream between the inflatable member and the interface junction.

The manifold may include a control valve that controls the flow of the inhalation air stream between the reaction chamber and the inflatable member.

The inflatable member may be configured to expand and contract in response to the exhalation air stream and the breathable inhalation air stream.

A center of the exhale valve may be arranged at a distance in a range of 0.10 to 2 inches from a connection point of the user interface and the interface junction in a direction of the flow of the exhalation air stream.

The interface junction may include an exhale tube configured to direct the flow of the exhalation air stream through the exhale valve of the interface junction and to the reaction chamber.

The inhale valve may be arranged at a distance in a range of 0.10 to 2 inches from a connection point of the user interface and the interface junction in a direction of the flow of the inhalation air stream.

The interface junction may include an inhale tube configured to direct the flow of the inhalation air stream from the inflatable member, through the inhale valve and to the user interface.

The reaction composition may react with $CO_2$ in the exhalation air stream to produce $O_2$.

The reaction composition may react with moisture in the exhalation air stream to produce $O_2$.

The reaction composition may include potassium super oxide.

The reaction chamber may be further configured to house a scrubbing composition that reacts with a component of the exhalation air stream. The component may be $CO_2$ and the scrubbing composition may remove $CO_2$ from the exhalation air stream. The reaction chamber may include a partition for porously separating the reaction composition from the scrubbing composition.

The apparatus may be configured to operate without the use of an oxygen candle.

A total weight of the apparatus may be in a range of 0.5 to 10 pounds.

The user interface may be formed of a material selected from the group consisting of light metals, nanocomposites and polymer materials.

The reaction chamber may be formed of a material selected from the group consisting of light metals, nanocomposites and polymer materials.

The interface junction may be formed of a material selected from the group consisting of light metals, nanocomposites and polymer materials.

The inflatable member may be formed of a plastic material.

The interface junction may be selected from the group consisting of a Y-junction and a T-junction.

The reaction chamber may include a plurality of side projections configured to hold the inflatable member away from an inside of the reaction chamber in a radial direction.

The apparatus may further comprise a protective covering configured to enclose the inflatable member in order to protect the inflatable member. The protective covering may be formed of a material selected from the group consisting of cloth, light metals, nanocomposites and polymer materials.

The reaction chamber may include a top filter disposed between a top surface of the reaction chamber and the reaction composition in the reaction chamber.

The reaction chamber may include a bottom filter disposed between a bottom surface of the reaction chamber and the reaction composition in the reaction chamber.

The interface junction may be disposed directly on the reaction chamber and in fluid connection with the inflatable member.

The reaction composition may be provided in a form selected from the group consisting of coarse powders, pellets, granules, tablets, and laminated sheets. The form of the reaction composition may be provided in bags or sleeves.

The form of the reaction composition may include at least one of punctures, grooves, ridges, and perforations.

The reaction composition may include at least one of a catalyst, adjuvant, and an initiator.

In another embodiment, there is provided a method of generating oxygen in a portable breathing apparatus. The method comprises receiving an exhalation air stream from and providing a breathable inhalation air stream to a user via a user interface, converting the exhalation air stream into the breathable inhalation air stream in a reaction chamber configured to house a reaction composition that reacts with the exhalation air stream in order to convert the exhalation air stream into the breathable inhalation air stream, controlling a flow of the exhalation air stream one-directionally from the user interface to the reaction chamber with an exhale valve of an interface junction disposed between the user interface and the reaction chamber, and controlling a flow of the inhalation air stream one-directionally from an inflatable member in communication with the reaction chamber to the user interface with an inhale valve of an interface junction disposed between the inflatable member and the user interface.

A center of the exhale valve may be arranged at distance in a range of 0.10 to 2 inches from a connection point of the user interface and the interface junction in a direction of a flow of the exhalation air stream.

A center of the inhale valve may be arranged at distance in a range of 0.10 to 2 inches from a connection point of the user interface and the interface junction in a direction of the flow of the inhalation air stream.

BRIEF DESCRIPTION OF THE DRAWINGS

Various embodiments will be described in detail, with reference to the following figures, wherein:

FIG. 21A is a perspective view of the reaction chamber manifold in FIGS. 20A-20C from a top view;

FIG. 21B is a perspective view of the reaction chamber manifold in FIGS. 20A-20C from a side view along a length of the manifold;

FIG. 21C is a perspective view of the reaction chamber manifold in FIGS. 20A-20C from a side view along a width of the manifold;

FIG. 22 is an exploded view of the reaction chamber manifold in FIGS. 20A-20C according to an embodiment;

DETAILED DESCRIPTION

Figure 1:
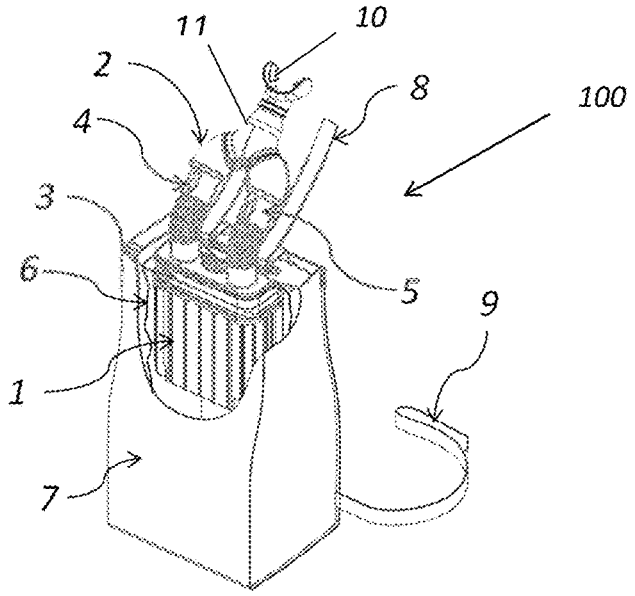
FIG. 1 is a perspective view of an oxygen-generating breathing apparatus according to a first embodiment.

FIG. 1 illustrates a portable, light-weight oxygen-generating breathing apparatus 100 according to a first embodiment. The apparatus 100 may include a reaction chamber 1 for housing a reaction composition for a chemical reaction that converts exhaled gas including, for example, $CO_2$, into oxygen gas that is suitable for inhalation by a user of the apparatus 100. The reaction chamber 1 may be connected, either directly or indirectly, to the interface junction 11. In turn, the interface junction 11 may be connected directly or indirectly to a user interface 10, e.g., mouthpiece. The interface junction 11 may include an exhale tube 4 and inhale tube 5 that connect the reaction chamber 1 to the mouthpiece 10.

In embodiments, the oxygen-generating breathing apparatus 100 may also include an inflatable member such as bladder 6 that is configured to be disposed around and enclose the reaction chamber 1 and be sealed, either directly to the reaction chamber 1 or indirectly via the manifold 3. The apparatus 100 may include a protective cover 7 configured to enclose the bladder 6 and/or reaction chamber 1 and to be connected, either directly or indirectly, to the reaction chamber 1 and/or bladder 6. The protective cover 7 may be rigid or flexible. The protective cover 7 may be comprised of a cloth or other woven material, hard plastic or polymer material. For example, the protective cover 7 may be constructed of ABS, PVC, nylon, TEFLON®, or any comparable heat-resistant polymer or mixture of polymers that does not easily conduct heat. In some embodiments, the protective cover 7 may be omitted.

The apparatus 100 may include detachable fastening elements such as, for example, neck straps 8, waist strap 9, or clips that can fasten to, for example, suspenders, belts, neckties or collars, for securely fastening the apparatus 100 to a user. FIG. 1 illustrates the neck straps 8 and waist strap 9 being connected to the reaction chamber 1 and protective cover 7, respectfully. However, the fastening elements may be situated in any suitable manner on the device for securely and detachably fastening the apparatus 100 to a user.

Figure 2A:
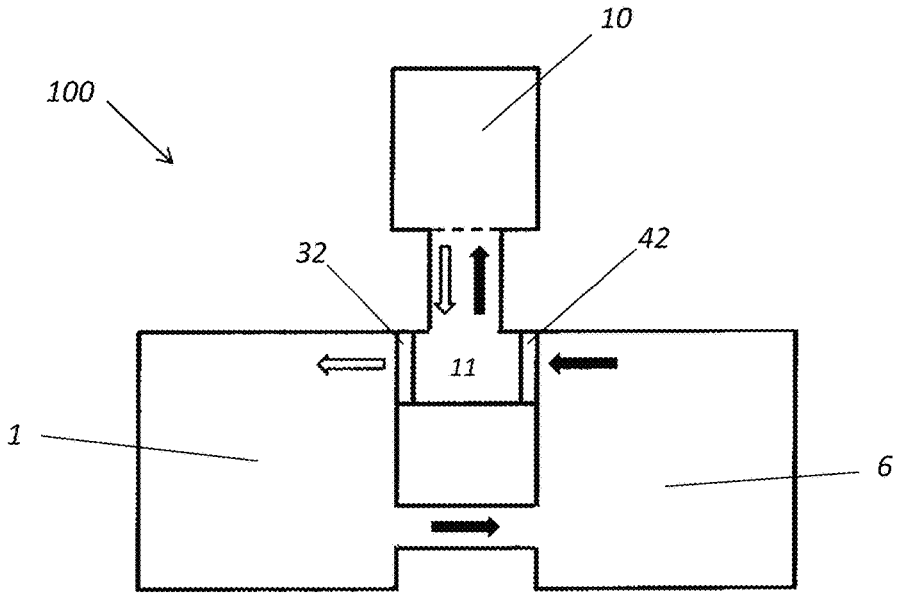
FIG. 2A is a schematic view of the oxygen-generating breathing apparatus in FIG. 1 with an interface junction according to an embodiment.

FIG. 2A schematically depicts an exemplary configuration and operation of the airflow in the apparatus 100 illustrated in FIG. 1. In this embodiment, there is a closed circuit one-directional airflow pathway for circulation of breathing gas between the user interface 10 and the reaction chamber 1 through the interface junction 11. The airflow pathway has an exhale pathway designated by hollow arrows and an inhale pathway designated by solid arrows. The interface junction 11 may be configured with an exhale valve 32 for allowing the one-directional flow of air exhaled from a user into user interface 10 through the exhale pathway, into reaction chamber 1, and into bladder 6, which are connected in series, as seen in FIG. 2A.

The interface junction 11 may be configured with an exhale valve 32 allowing for the one-directional flow of exhaled air by the user into the user interface 10 through the exhale pathway through the reaction chamber 1 to the bladder 6 and an inhale valve 42 allowing for the one-directional flow of air inhaled by a user into user interface 10 through inhale pathway from the bladder 6, as seen in FIG. 2A. In embodiments, valves 32 and 42 of the user interface 11 are arranged as close as possible to mouthpiece 10 to minimize re-breathed air. This configuration significantly reduces the amount of $CO_2$ exhaled by the user that may be re-breathed by the user.

Figure 2B:
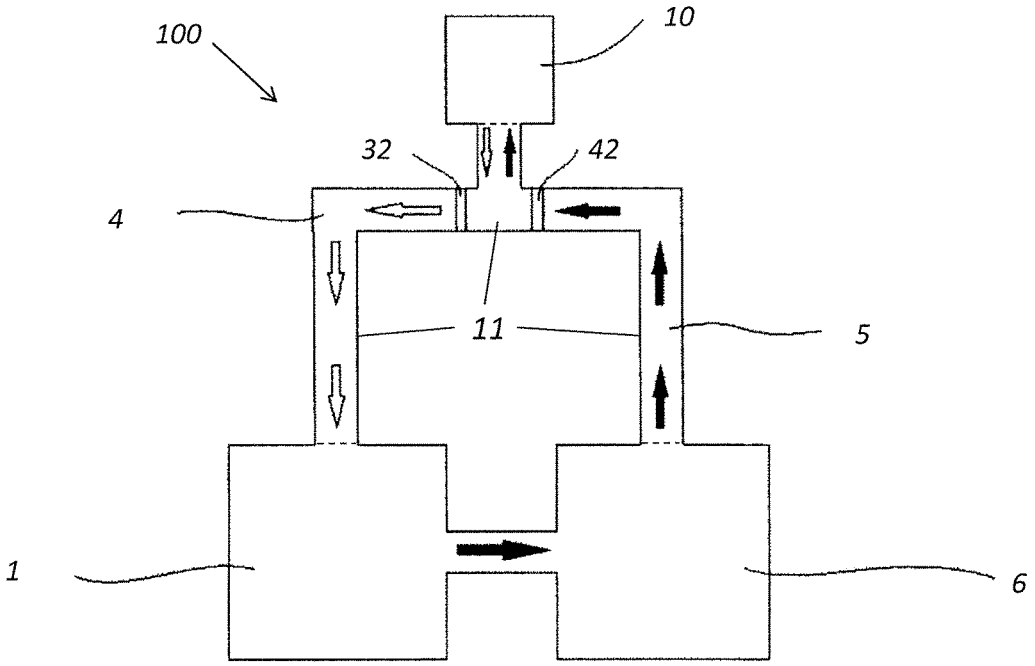
FIG. 2B is a schematic view of the oxygen-generating breathing apparatus in FIG. 1 with an interface junction according to another embodiment.

FIG. 2B schematically illustrates another embodiment of the interface junction 11. In this embodiment, the interface junction 11 includes exhale tube 4 and inhale tube 5. The one-directional airflow exhale and inhale pathways flow through the interface junction 11 via the exhale tube 4 and inhale tube 5, respectively, as shown in FIG. 2B. The configuration of the exhale tube 4 and inhale tube 5 allows for variability and customization of the design of the apparatus to accommodate the reaction chamber and bladder to be worn away from the face, such as on the chest or back. In this embodiment, like the embodiment of FIG. 2A, the reaction chamber 1 and the bladder 6 are connected in series.

Figure 2C:
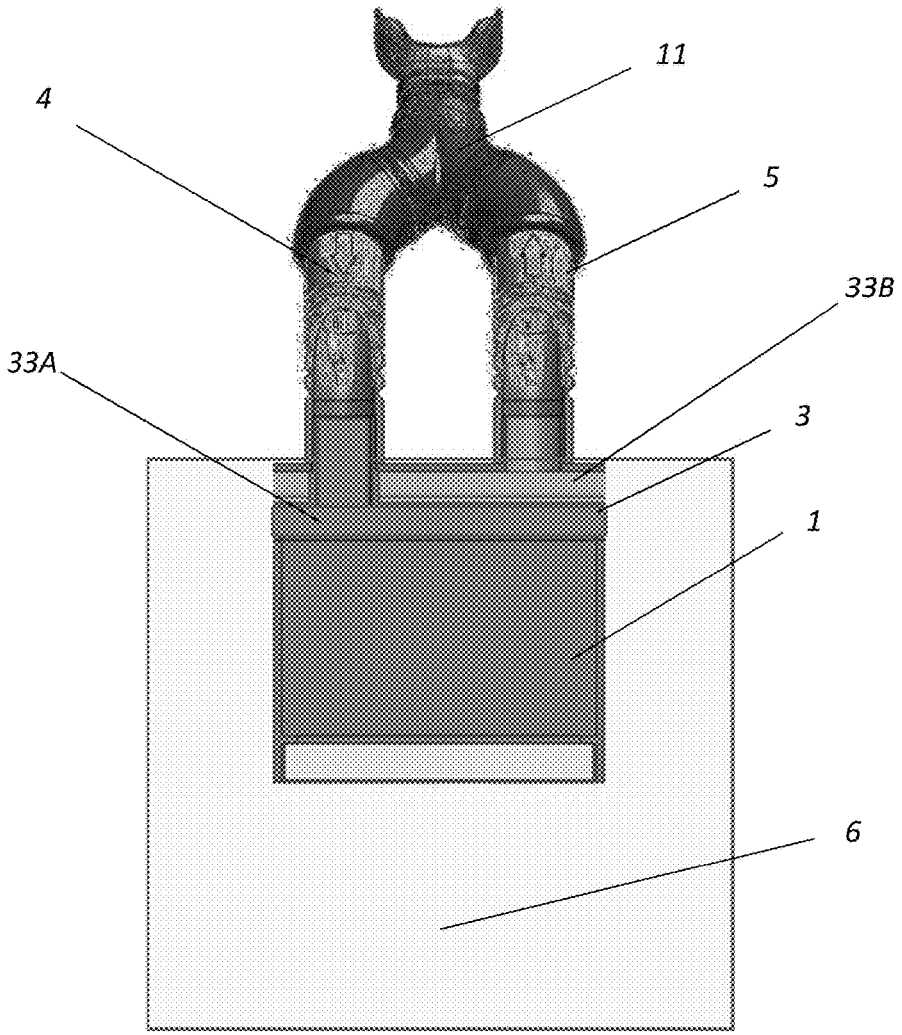
FIG. 2C is a perspective view of the oxygen-generating breathing apparatus in FIG. 1 with an interface junction according to another embodiment.
Figure 2D:
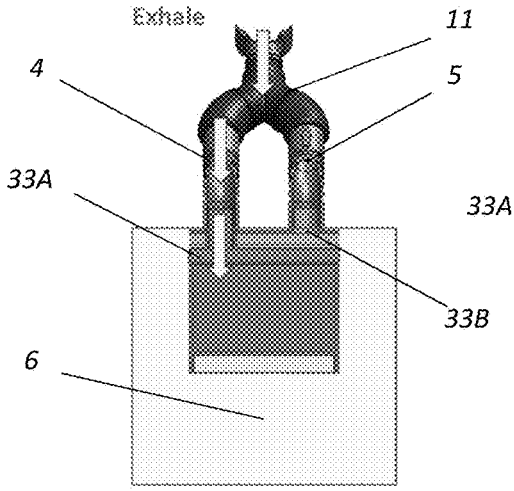
FIG. 2D is a perspective view of the oxygen-generating breathing apparatus in FIG. 2C illustrating a portion of an exhale pathway.
Figure 2F:
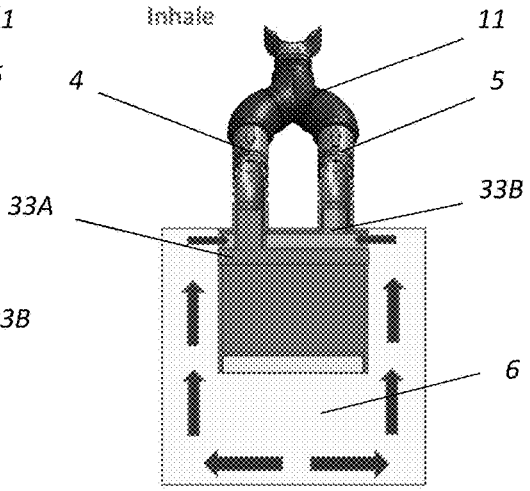
FIG. 2F is a perspective view of the oxygen-generating breathing apparatus in FIG. 2C illustrating a portion of an inhale pathway.
Figure 2E:
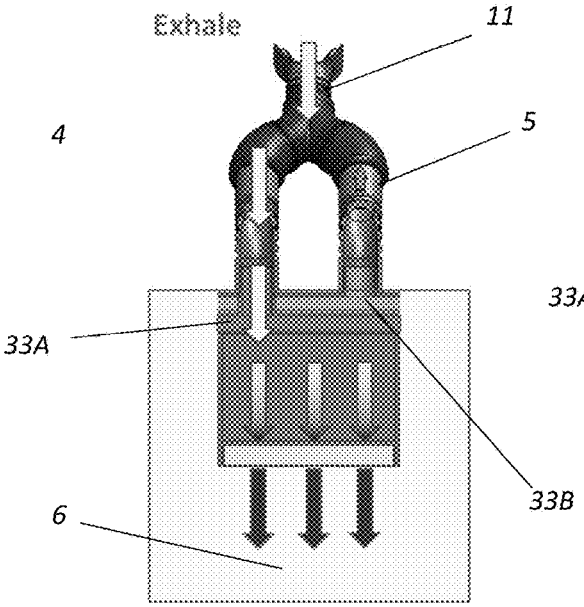
FIG. 2E is a perspective view of the oxygen-generating breathing apparatus in FIG. 2C illustrating a further portion of the exhale pathway.
Figure 2G:
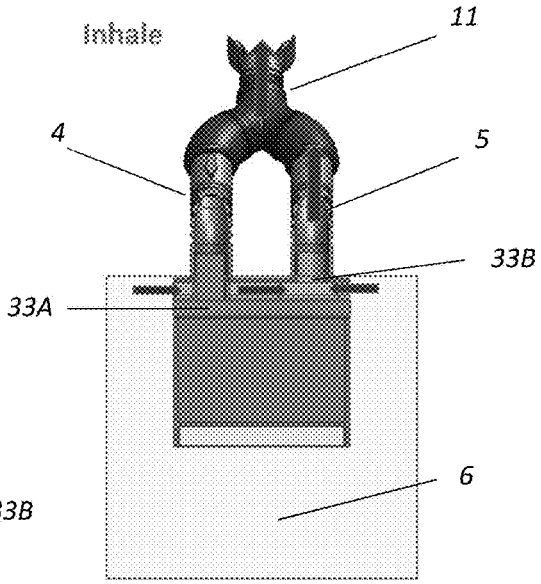
FIG. 2G is a perspective view of the oxygen-generating breathing apparatus in FIG. 2C illustrating a further portion of the inhale pathway.

In another embodiment shown in FIG. 2C, the one-directional flow of air exhaled from a user through the exhale pathway via the interface junction 11 flows into manifold exhale portion 33A of the manifold 3, which is configured to allow the flow of the exhaled air into the reaction chamber 1 which is enclosed by the bladder 6, as seen in FIG. 2C. The flow of the air through the apparatus shown in FIG. 2C is illustrated in FIGS. 2D-2G, in which hollow arrows represent exhalation, $CO_2$-rich, air and the solid arrows represent, inhalation, $O_2$-rich, air. First, the exhalation air is received through the user interface 10 and proceeds through the exhale tube 4, through the manifold exhale portion 33A and into the reaction chamber 1, as shown in FIG. 2D. Next, $O_2$-rich air generated in the reaction chamber 1 flows into the bladder 6 where it continues downstream via the inhalation pathway, as shown in FIG. 2E. In FIG. 2F, the $O_2$-rich air in the bladder 6 circulates and flows back through manifold inhale portion 33B of the manifold 3. Finally, the $O_2$-rich air flows through inhale tube 5 and through the user interface 10 back to the user.

Bladder 6 is designed to change in shape in relation to the user's tidal volume when breathing. The bladder 6 expands and contracts when the user breathes, letting the total volume of gas in the user's lungs and the apparatus remain substantially constant throughout the breathing cycle. The volume of the bladder 6 is configured to allow for the maximum likely breath volume of a user or class of users.

Figure 3:
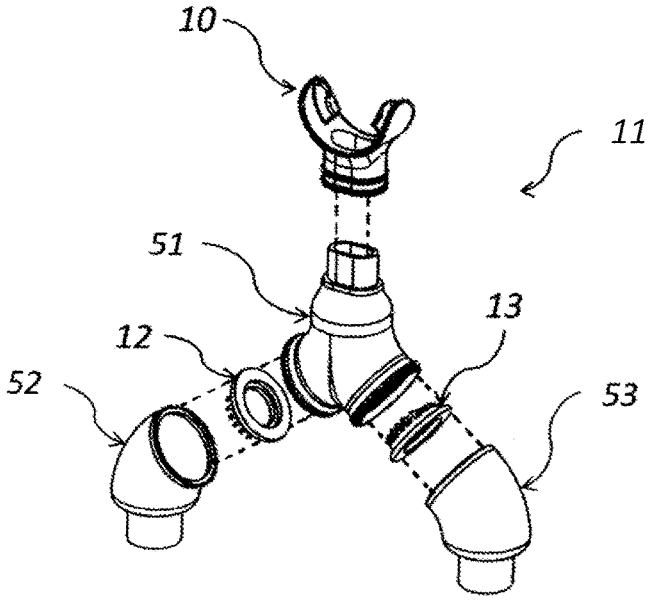
FIG. 3 is an exploded view of a user interface and an interface junction of the oxygen-generating breathing apparatus according to an embodiment.

FIG. 3 illustrates an embodiment of the user interface 10 and interface junction 11. User interface 10 may be a mouthpiece. The mouthpiece 10 may be connected to an interface junction 11, shown as a Y-type interface junction or T-type interface junction in this embodiment. The exhale valve 12 and inhale valve 13 are configured within the interface junction 11.

In the embodiment of the Y-type interface junction, the mouthpiece 10 connects to port 51 of Y-type interface junction 11. Y-type interface junction 11 has an exhale branch 52 and an inhale branch 53. An exhale valve 12 may be positioned between exhale branch 52 and port 51 and inhale valve 13 may be positioned between inhale branch 53 and port 51. The design of the interface junction 11 is such that the volume of air in port 51 is minimal providing for efficient use of the oxygenated air by minimizing mixing of exhale and oxygenated air.

Figure 4:
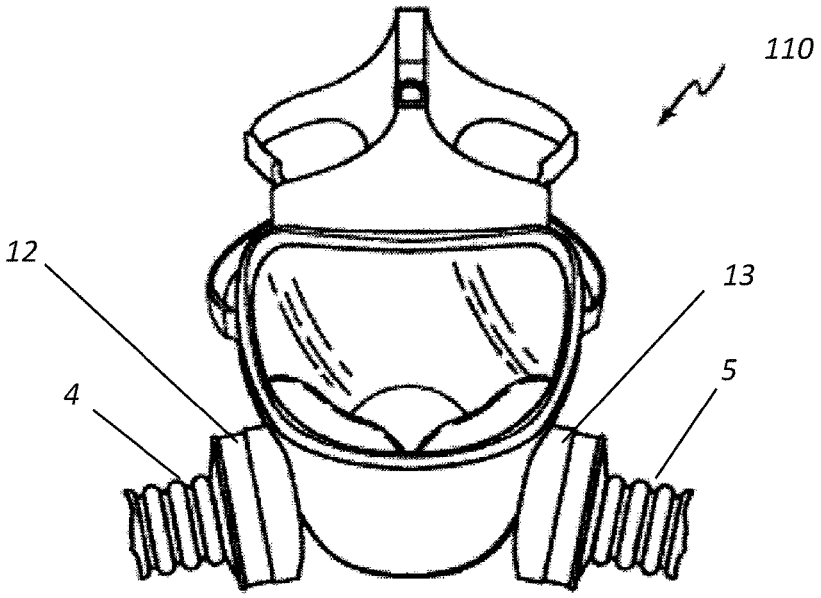
FIG. 4 is a perspective view of a user interface and interface junction of the oxygen-generating breathing apparatus according to an embodiment.

FIG. 4 illustrates another embodiment of the user interface 10. As seen in FIG. 4, face mask 110 provides full coverage of the user's face by covering the eyes, nose and mouth of the user behind a secure transparent viewing shield. The face mask 110 may be connected to the reaction chamber 1 via the above-described user interface and related components. The face mask 110 may also include valves 12 and 13, and be directly connected to the reaction chamber 1 via exhale tube 4 and inhale tube 5 without the Y-type interface junction 11, as shown in FIG. 4.

Figure 5:
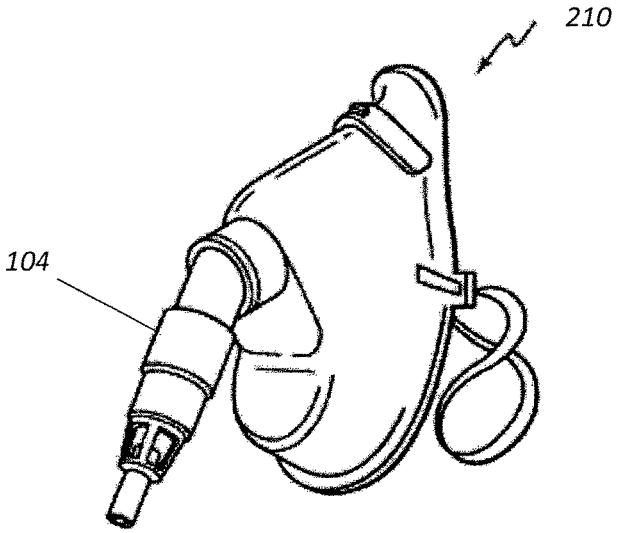
FIG. 5 is a perspective view of a user interface and interface junction of the oxygen-generating breathing apparatus according to an embodiment.

FIG. 5 illustrates yet another embodiment of the user interface 10. As seen in FIG. 5, face mask 210 provides partial coverage of the user's face by covering the nose and mouth of the user. The face mask 210 may be connected to the reaction chamber 1 according to any of the above-described embodiments. The face mask 210 may include valves 12 and 13, and also be directly connected to the reaction chamber 1 via a dual inhale/exhale tube 104 without the Y-type interface junction 11, as shown in FIG. 5.

Figure 6:
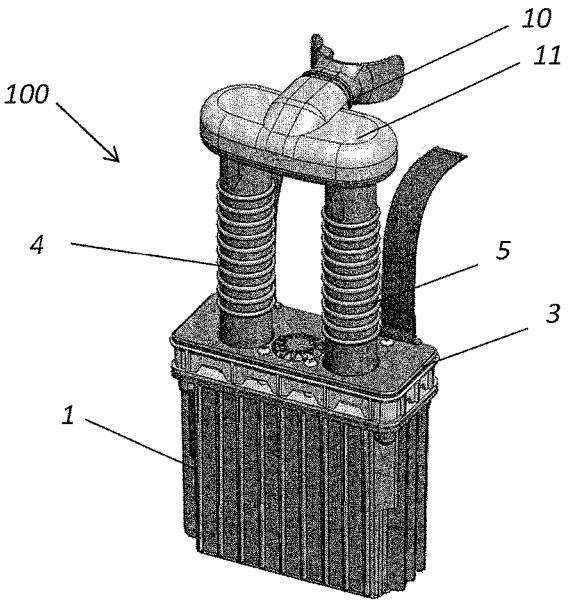
FIG. 6 is a perspective view of a user interface, interface junction and reaction chamber of the oxygen-generating breathing apparatus according to an embodiment.

FIG. 6 illustrates a manifold 3 atop the reaction chamber 1. The manifold 3 is connected to the user interface 10 via exhale tube 4 and inhale tube 5 as part of a T-type interface junction 11.

Figure 7A:
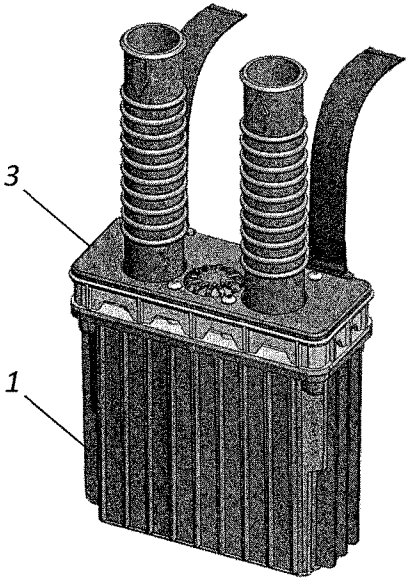
FIG. 7A is a perspective view of a reaction chamber of the oxygen-generating breathing apparatus according to an embodiment.
Figure 7B:
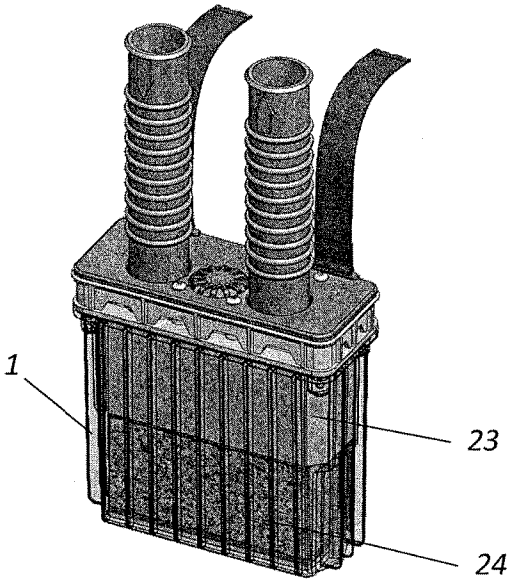
FIG. 7B is a perspective view of the reaction chamber in FIG. 7A illustrating the inside of the chamber.
Figure 7C:
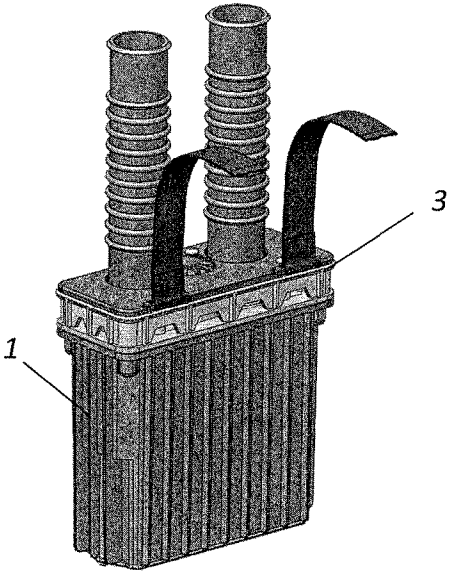
FIG. 7C is a perspective view of the reaction chamber in FIG. 7A from another angle.

FIGS. 7A-7C depict various views of the configuration of the reaction chamber 1. FIGS. 7A and 7B show a front view of the reaction chamber 1, i.e., the surface of the chamber 1 that is away from the user's body when secured to the user's body. FIG. 7C shows a back view of the reaction chamber 1, i.e., the surface of the chamber 1 that is facing the user's body when secured to the user's body. FIG. 7B further illustrates the inside of the reaction chamber 1 that includes a reaction composition 23, such as, for example, a super oxide composition, such as potassium superoxide. The inside of the reaction chamber 1 may further include a special scrubbing composition 24, such as, for example, a $CO_2$ scrubber. According to embodiments, the carbon dioxide and moisture from the exhaled air coming from the exhale tube 4 react with the potassium superoxide composition 23 and produce oxygen gas to be returned to the user via the inhale tube 5. This reaction thus lowers the amount of carbon dioxide in the exhaled air and increases the amount of oxygen.

The term "potassium superoxide composition" encompasses pure potassium superoxide ($KO_2$), or mixtures comprising $KO_2$ and at least one of potassium monoxide ($K_2O$) and potassium peroxide ($K_2O_2$), such as is disclosed in U.S. Pat. No. 7,513,251, which is incorporated herein by reference. In the composition, $KO_2$ may be present in an amount of from 50 to 99.9 wt %, 70 to 99 wt %, or 80 to 97 wt %, of the total weight of the potassium oxides ($KO_2$+$K_2O$+$K_2O_2$) present in the composition, such as, for example, from 50 to 70 wt %, from 60 to 80 wt %, from 70 to 85 wt %, from 80 to 99.9 wt %, from 75 to 93 wt %, from 80 to 90 wt %, from 75 to 80 wt %, from 80 to 85 wt %, from 85 to 90 wt %, from 90 to 95 wt %, or from 95 to 99 wt %. In embodiments, the amount of super oxide composition may range from, for example, 1 g to 1 kg, from 10 g to 800 g, 50 g to 600 g, 75 g to 550 g, 100 g to 325 g, 150 g to 300 g, 175 g to 275 g, or 200 g to 250 g.

The amount of oxygen generated by the reaction chamber 1 is independently dependent upon the configuration and design of the breathing apparatus, the amount of $KO_2$ in the superoxide composition, the purity of $KO_2$ in the superoxide composition and the breathing rate of the user. The surface area of the $KO_2$ in the superoxide composition also influences the amount of oxygen generated by the reaction chamber 1. In embodiments, the reaction chamber 1 may be configured to generate up to 90 minutes of emergency oxygen. The bladder 6 should have an interior volume capacity in the range of from 0.05 L to 10 L, or 1 L to 8 L, 2 L to 6 L, or 3 L to 5 L. It will be understood that the amount of exertion by the user will affect how quickly the reaction proceeds.

Figure 28A:
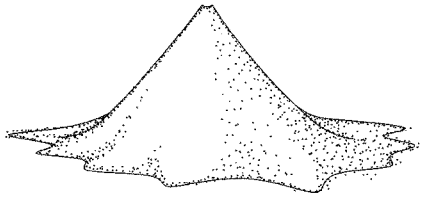
FIG. 28A illustrates a powdered form of the potassium superoxide composition according to an embodiment.
Figure 28B:
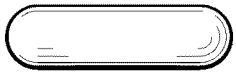
FIG. 28B illustrates a pellet form of the potassium superoxide composition according to an embodiment.
Figure 28C:
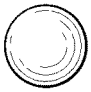
FIG. 28C illustrates a granular form of the potassium superoxide composition according to an embodiment.
Figure 28D:
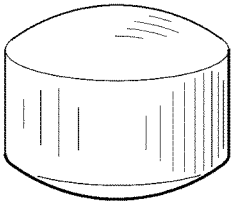
FIG. 28D illustrates a tablet of the potassium superoxide composition according to an embodiment.
Figure 28E:
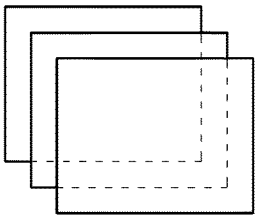
FIG. 28E illustrates a laminated sheet form of the potassium superoxide composition according to an embodiment.
Figure 28F:
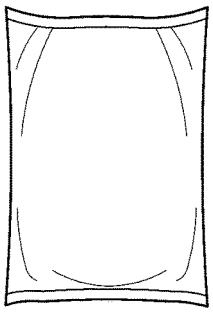
FIG. 28F illustrates a sleeved or bagged form of the potassium superoxide composition according to an embodiment.
Figure 28G:
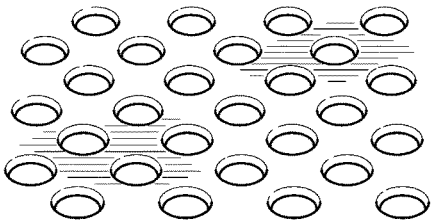
FIG. 28G illustrates a punctured or perforated form of the potassium superoxide composition according to an embodiment.
Figure 28H:
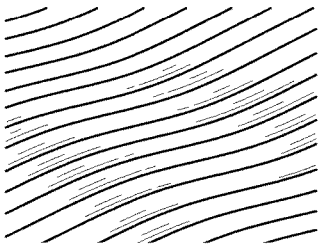
FIG. 28H illustrates a grooved and ridged from of the potassium superoxide composition according to an embodiment.

The potassium superoxide composition may be in the form of, for example, a coarse powder (shown in FIG. 28A), pellets (shown in FIG. 28B), granules (shown in FIG. 28C), tablets (shown in FIG. 28D), or one or more laminated sheets (shown in FIG. 28E), any of which may be provided in a bag or sleeve material (shown in FIG. 28F) including, for example fiberglass or graphite, in order to prevent the tablets from fusing to each other. Each bag may contain, for example, 10 to 300 grams, 25 to 150 grams, or 50 to 100 grams of the potassium superoxide composition. The size of the bag is dependent upon the amount of potassium superoxide composition required for optimal use, as described herein. Some forms of the potassium superoxide composition may contain punctures (shown in FIG. 28G), grooves (shown in FIG. 28H), ridges (shown in FIG. 28H), and/or perforations (shown in FIG. 28G) that function to increase the surface area of the potassium superoxide composition exposed to the exhaled air, which increases the amount of the potassium superoxide composition consumed and in turn the amount of oxygen generated during the use of the apparatus.

Similarly, in order to accommodate the potassium super oxide composition, the reaction chamber 1 may be of sufficient size to contain the potassium superoxide composition in the forms and amounts described herein. It will be understood that lesser amounts of potassium super oxide composition can be used for smaller or shorter-use devices, and that greater amounts of potassium super oxide composition can be used for larger or longer-use devices.

In embodiments, the reaction chamber 1 may contain graphite or carbon to help regulate moisture absorption, reduce the exotherm and prevent fusing of the composition under high utilization. The graphite or carbon may be in the form of, for example, graphite or carbon fiber fabric(s). In embodiments, the thickness of the graphite or carbon fiber fabric(s) may range from about 1 mm to about 6 mm. The graphite and carbon fiber fabric(s) eliminate the need for a screen by acting as a filter to prevent the passage of any $KO_2$ dust particles. In various other embodiments, the container may contain anhydrous LiOH or $Li_2O_2$ to help regulate moisture absorption and reduce the exotherm.

In various embodiments, graphite or carbon fiber fabric(s) may be layered between every 25 mm to 75 mm of potassium super oxide, present as a pellet(s), a granule(s) or a laminated sheet(s). In various other embodiments, the potassium super oxide may be present in the form of sheets, and the graphite or carbon fiber fabric(s) may be placed on the bottom and around the inside of the reaction chamber 1.

In embodiments, the potassium superoxide composition may contain one or more catalysts, adjuvants, and/or initiators. The catalysts may be, for example, one or more of $NaO_2$, $Na_2O$, $Na_2O_2$, $Ca_2O_2$, $Ba_2O_2$, $Li_2O_2$, oxides of rubidium, and oxides of cesium. In embodiments, the catalyst is preferably selected from $NaO_2$ and $Na_2O_2$. The catalyst may serve to reduce the amount of heat produced by the oxygen-generating reaction, and further may slow down the reaction time. In some other embodiments, a samarium/gadolinium oxide mix is used as a catalyst in an amount of from 0.005 to 5 wt %, 0.05 to 3 wt %, or 0.1 to 0.5 wt %, with respect to the total weight of the potassium superoxide composition. The initiator may be, for example, a copper compound such as, for example, one or more of copper oxychloride, $CuCl_2$, and CuCl. The amount of initiator present may be, for example, from 0.01 to 20.0 wt %, 0.05 to 15 wt %, 0.1 to 5 wt %, 0.2 to 1.5 wt %, or 0.25 to 1.0 wt %, with respect to the total weight of the potassium superoxide composition. In various embodiments, the amount of the one or more catalysts, adjuvants, and/or initiators present in the container is, for example, 1% to 35%, 2% to 25%, 3% to 15%, or 5% to 10% of the total weight of the potassium superoxide composition.

The carbon dioxide scrubbing composition 24 may be positioned in the reaction chamber 1 beneath the potassium super oxide composition 23, as shown in FIG. 7B. The carbon dioxide scrubbing composition 24 further reduces the amount of carbon dioxide present in the air after it passes by and reacts with the potassium superoxide composition. The carbon dioxide scrubbing composition may contain granular soda lime, zeolite, molecular sieves, or $Li_2O_2$, or combinations thereof, which removes carbon dioxide from the gas mixture and leaves the oxygen and other gases available for re-breathing. Typically, the scrubbing composition does not generate oxygen when removing the $CO_2$.

The carbon dioxide passing through the carbon dioxide scrubbing composition 24 is removed as it reacts with the carbon dioxide scrubbing composition. The carbon dioxide scrubbing composition has a finite life based on the quantity of the composition, the level of $CO_2$ within the treated gas, the granularity and composition of the carbon dioxide scrubbing composition, and the ambient temperature, among other things. Once the carbon dioxide scrubbing composition is consumed, $CO_2$ breakthrough will occur and the $CO_2$ level in the exiting gas stream begins to increase.

Figure 8B:
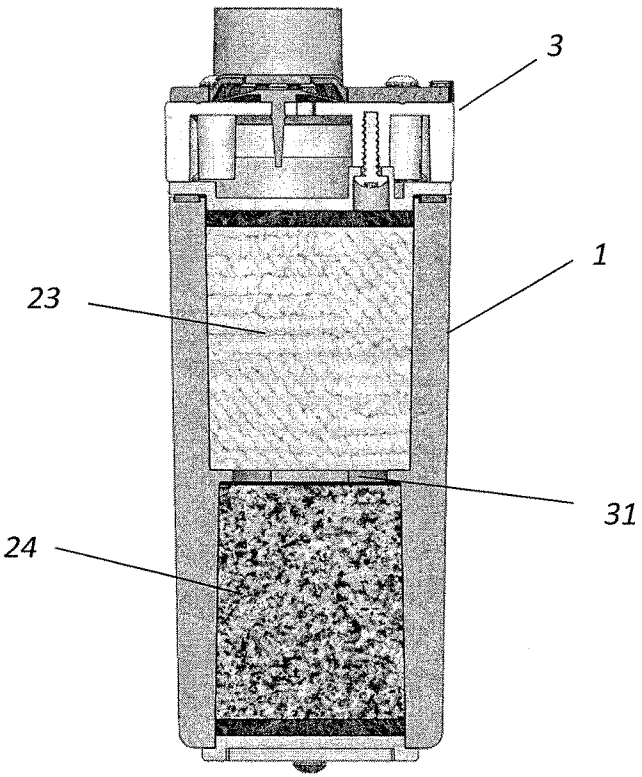
FIG. 8B is a cross-sectional schematic view of the reaction chamber in FIGS. 7A-7C along a width direction of the chamber.
Figure 8A:
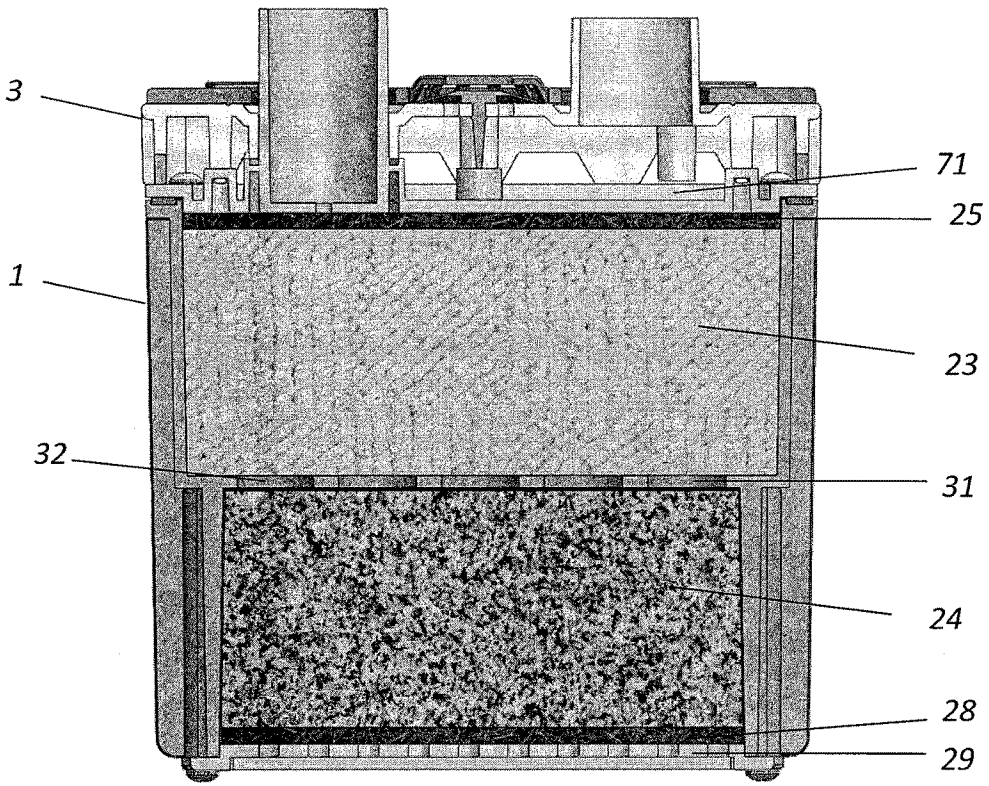
FIG. 8A is a cross-sectional schematic view of the reaction chamber in FIGS. 7A-7C along a length direction of the chamber.

The interior of the reaction chamber 1 may be configured with a mesh screen or basket configured to hold the potassium superoxide composition. The mesh screen or basket 62 may be made from any suitable material including, but not limited to, fiberglass, stainless steel, carbon steel, titanium, nickel, or anodized aluminum. As shown in FIGS. 8A and 8B, the reaction chamber 1 may have a partition 31 between the potassium super oxide composition 23 and carbon dioxide scrubbing composition 24. Partition 31 may be configured with one or more apertures 32 to allow the air oxygenated by the potassium super oxide composition 23 to flow into the carbon dioxide scrubbing composition 24.

Reaction chamber 1 may further include one or more treated or untreated filters 25, 28 to prevent the passage of dust particles from the carbon dioxide scrubbing composition and/or the potassium super oxide composition. As shown in FIGS. 8A and 8B, top filter 25 may be positioned between manifold bottom plate 71 and potassium super oxide composition 23, and bottom filter 28 is positioned between bottom cover 29 of the reaction chamber and carbon dioxide scrubbing composition 24. An optional filter (not shown) may be positioned between the potassium super oxide composition and the carbon dioxide scrubbing composition, for example between the potassium super oxide composition 23 and partition 31 or between partition 31 and carbon dioxide scrubbing composition 24. In embodiments, the filter may function as the partition between the potassium super oxide composition and the carbon dioxide scrubbing composition. One or more filters may be positioned in other places along the exhale and inhale pathways, such as in the exhale tube 4 and inhale tube 5, or proximate to or integral with an exhale or inhale valve.

Such filters may comprise any suitable material known in the art, such as, for example, graphite fiber fabric, carbon fiber fabric, fiberglass, polypropylene, nylon, dacron, polyurethane, foam rubber, and metallic wool, such as steel/stainless steel wool. The filter material may be configured as a fine screen or as a felt-type fabric, although any other configuration known in the art may be used. The filter material may be treated with certain food grade acids to produce a treated filter that is sufficiently acidic to chemically neutralize any KOH and $KO_2$ particles contacting it, including those that are smaller than 10 μm in diameter. Thus, any particles that do pass through the filter become a neutral food grade potassium compound. The filter material may be treated, for example, by first soaking it in a solution of the food grade acid, and then vacuum evaporating the water or impregnating the acids directly into the fiber. Suitable food grade acids include: citric acid, malic acid, fumaric acid, tartaric acid, acetic acid, ascorbic acid, boric acid, EDTA, erythorbic acid, gluconic acid, hydrochloric acid, phosphoric acid, meta-phosphoric acid, phosphorous acid, sulfuric acid, propionic acid, levulinic acid, tannic acid, glutamic acid, nicotinic acid, perchloric acid, and mixtures thereof.

The reaction chamber 1 may be made from any suitable high temperature-resistant material, such as, for example, light metals, nanocomposites or high temperature-resistant polymer materials that have a softening point of greater than about 250° C., such as, for example, perfluoroelastomers, or polymers including aromatic cycles or heterocycles, polyimides, polybenzoxazoles (PBOs), polybenzimidazoles, and polybenzthiazoles (PBTs). Other suitable materials may include, but are not limited to, thermoplastic elastomers such as styrenic block copolymers, thermoplastic olefins, elastomeric alloys, thermoplastic polyurethanes, thermoplastic copolyester and thermoplastic polyamides. The term "thermoplastic elastomer" is intended to mean a polymeric material that combines the mechanical properties of a thermoset rubber, i.e. resiliency, softness, and toughness, with the production economics of a thermoplastic polymer. These materials have varying patterns of hard and soft segments included in the polymer chain or compound. The hard segments melt or soften at processing temperatures, producing a melt processable material for ease of fabrication. In block copolymer thermoplastic elastomers, the hard and soft regions are in the same polymer chain. Descriptions of various types of thermoplastic elastomers may be found in Modern Plastics Encyclopedia 1988, Vol. 64, No. 10A, pp. 93-100 (October 1987), and in Modern Plastics Encyclopedia 1990, Vol. 66, No. 11, pp. 122-131 (Mid-October 1989), both incorporated herein by reference.

In embodiments, the reaction chamber 1 may be made of aluminum or other light-weight metal. For example, other suitable metals that may be used to form the chamber include aluminum alloys, magnesium, tin, thin wall steel, such as titanium, stainless steel and carbon steel, and the like. The metal may be spray coated or anodized to help prevent the metal from potentially reacting with KOH in solution. Other metals may be used depending upon the size of the reaction chamber and its intended use. For example, where the reaction chamber is expected to be relatively small, the selection of a specific metal may be less important because the weight of the metal becomes less of a concern. Alternatively, the reaction chamber may be made of a ceramic material, fiberglass, tempered (shatter-proof) glass, or TEFLON®.

The interior of the reaction chamber 1 may be coated with an inert polymer so that the active ingredients inside of the chamber do not react with the chamber. For example, various chemical-resistant coatings are known in the art, and can readily be incorporated into a protective coating layer primarily for the inside of the chamber. Suitable chemical-resistant coatings include, but are not limited to, halogenated materials such as HALAR® ethylene-chlorotrifluoroethylene copolymer (ECTFE) (Allied Chemical Corporation, Morristown, N.J.), TEFZEL® ethylene-tetrafluoroethylene (ETFE) (E.I. duPont de Nemours and Co. Wilmington, Del.), tetrafluoroethylene (TFE), TEFLON® polytetrafluoroethylene (PTFE), polytetrafluoroethylene fluorinated ethylene propylene (PTFE-FEP), polytetrafluoroethylene perfluoroalkoxy (PTFE-PFA), polyvinylidene fluoride (PVDF), polyethylene, polypropylene, and the like. TEFLON® (polytetrafluoroethylene or PTFE) is particularly preferred, in terms of its chemical properties and ready commercial availability.

The reaction chamber 1 may be configured with a stainless steel tube containing a sodium-potassium eutectic alloy in liquid form (NaK), which absorbs heat generated during the exothermic reaction. The stainless steel tube may be present as a straight tube, or may be present as a coil, which is capable of absorbing more heat than the straight tube. The stainless steel tube may have a diameter of about 6 mm to about 8 mm. Furthermore, the stainless steel tube may have thin walls having a thickness of about 1 mm. The length of the stainless steel tube may vary depending on the size of the container. For example, the stainless steel tube may have a length of from about 100 mm to about 150 mm. The stainless steel tube may extend from about the top to about the bottom of the container.

The bladder 6 should be inflatable, and may be composed of a material that will not melt or breakdown at a temperature lower than 150° C., such as lower than 160° C., 170° C., 180° C., 190° C., 200° C., 210° C., 220° C., 230° C., or 240° C. The bladder 6 may be made from any suitable high-temperature plastic or polymer material such as, for example, the material used in a conventional turkey bag. In embodiments, the plastic may include, but is not limited to, polyethylene-based polymers such as, for example, polyethylene terephthalate.

Figure 9A:
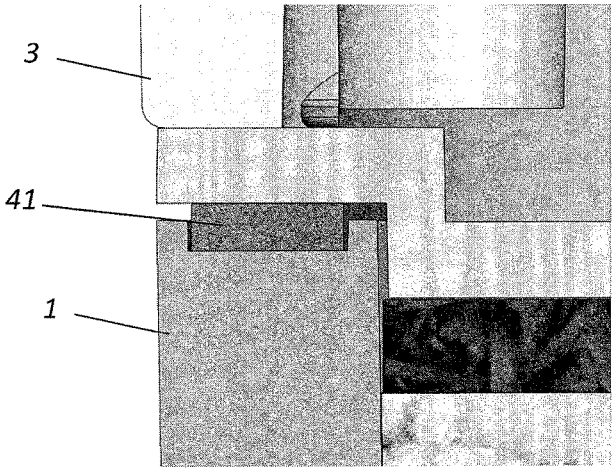
FIG. 9A is a schematic view of a gasket joint used in sealing the reaction chamber in FIGS. 7A-7C according to an embodiment.
Figure 9B:
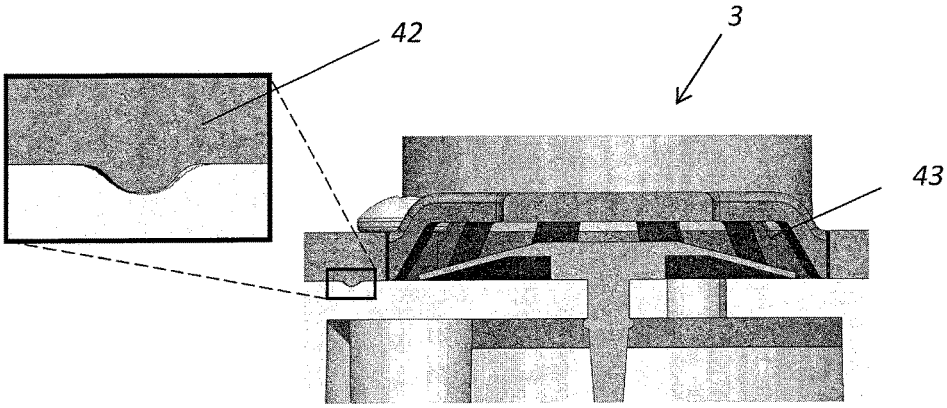
FIG. 9B is a schematic view of a bag seal joint and relief valve protection grill used in constructing the reaction chamber in FIGS. 7A-7C according to an embodiment.
Figure 10:
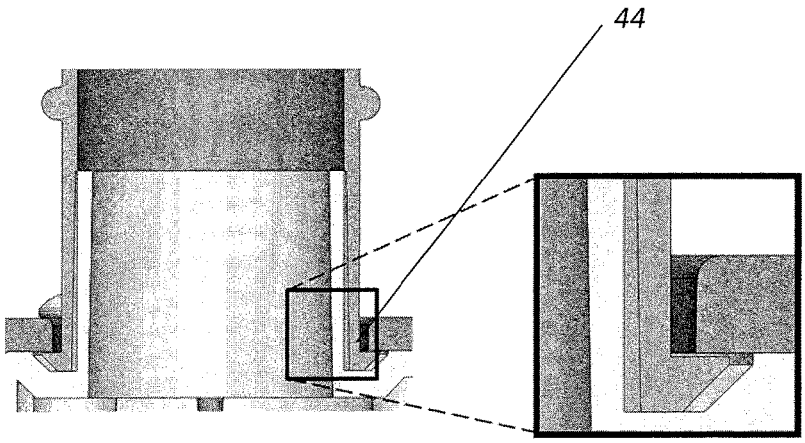
FIG. 10 is a schematic view of a tube connection used in constructing the reaction chamber in FIGS. 7A-7C according to an embodiment.
Figure 11:
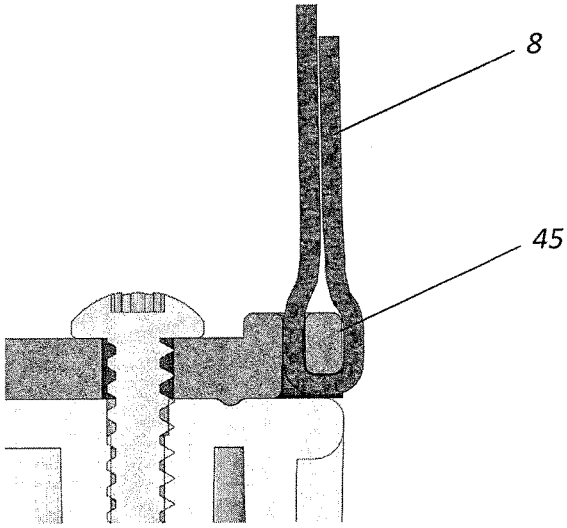
FIG. 11 is a schematic view of a strap connection used in constructing the reaction chamber in FIGS. 7A-7C according to an embodiment.

In embodiments, the reaction chamber 1 may be connected to the manifold 3 via any suitable means. As seen in FIG. 9A, a gasket joint 41 may be used. The bladder 6 may be connected to the reaction chamber 1 and/or manifold 3 via any suitable means. As seen in FIG. 9B, a bag seal joint 42 may be used to seal the bladder 6 to a relief valve protection grill portion 43 of the manifold 3. The exhale tube 4 and inhale tube 5 may be connected to the manifold 3 via any suitable means. For example, a tube connection 44 may be used to connect the tubes 4, 5 to the manifold 3, as seen in FIG. 10, which illustrates the tube in its molded condition. The connection 44 will expand into the groove when pushed over plastic. The straps 8, 9 may be connected to the manifold 3 and protective covering 7 via any suitable means. For example, a strap connection 45 may be used to connect the straps 8, 9 to the manifold 3 and casing 7, as seen in FIG. 11, which illustrates the strap 8 connected to the manifold 3.

Figure 12:
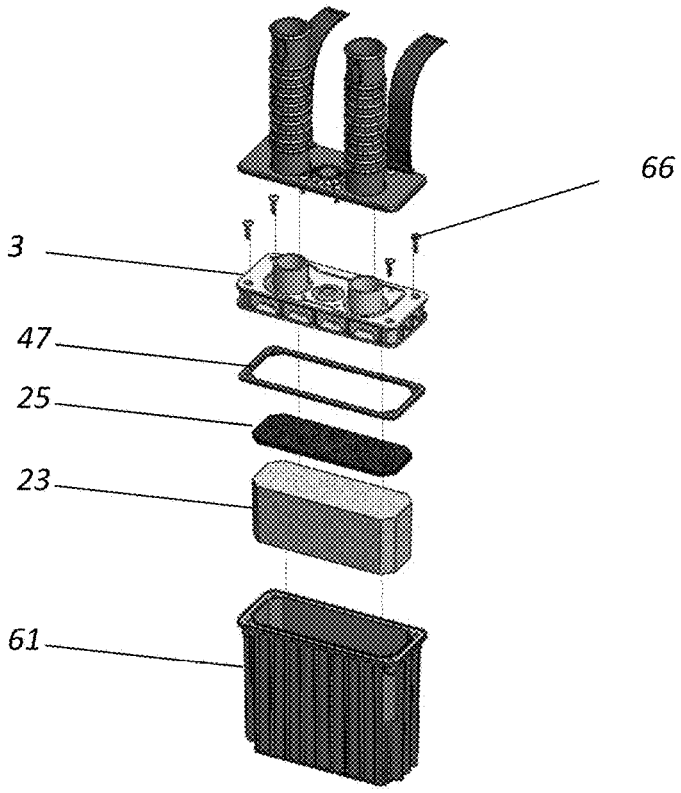
FIG. 12 is an exploded view of the reaction chamber in FIGS. 7A-7C.
Figure 13:
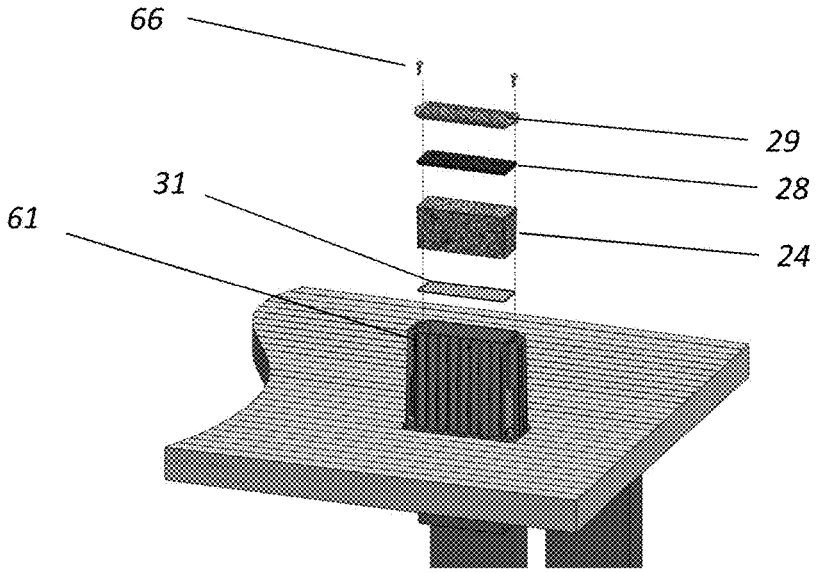
FIG. 13 is another exploded view of the reaction chamber in FIGS. 7A-7C.
Figure 14:
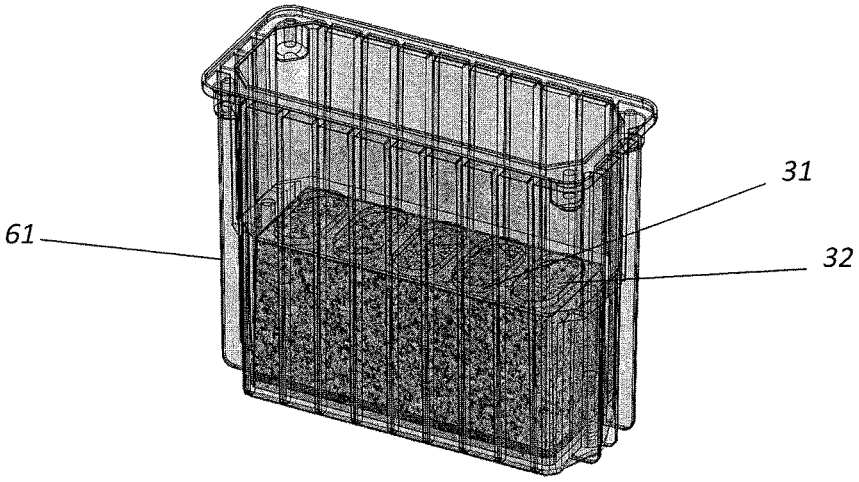
FIG. 14 is another perspective view of the reaction chamber in FIG. 7A illustrating the inside of the chamber.
Figure 15B:
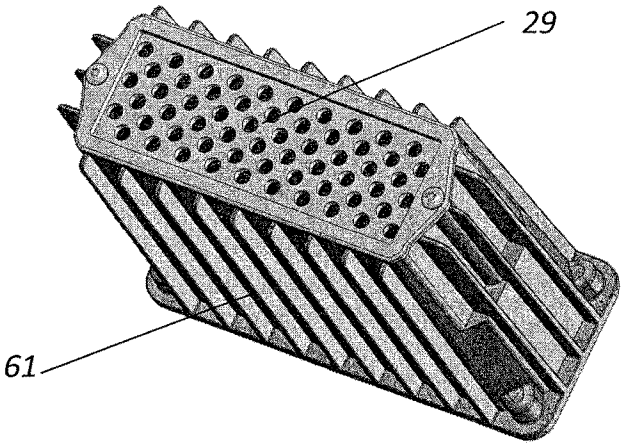
FIG. 15B is perspective view of the reaction chamber in FIG. 7A from the angle in FIG. 15A illustrating a bottom cover according to an embodiment.
Figure 15A:
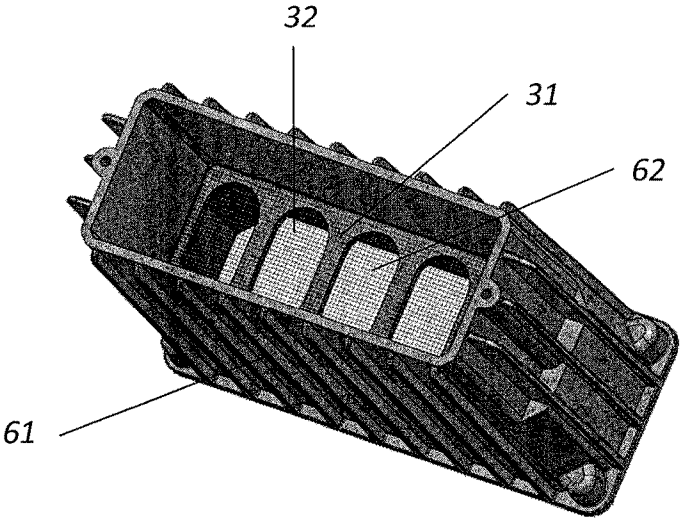
FIG. 15A is perspective view of the reaction chamber in FIG. 7A from another angle illustrating a screen according to an embodiment.
Figure 16:
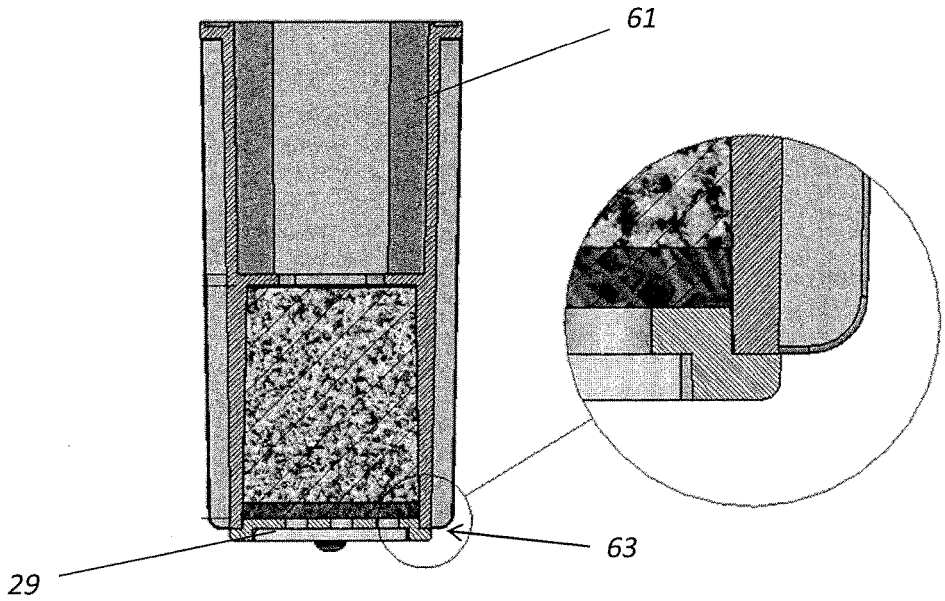
FIG. 16 is a cross-sectional schematic view of the reaction chamber in FIG. 14 along a width direction of the chamber.
Figure 17:
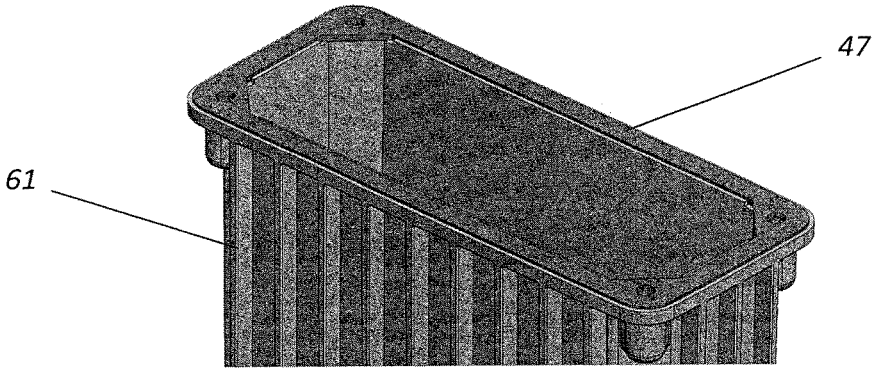
FIG. 17 is a schematic view of a lip modification used in constructing the reaction chamber in FIGS. 7A-7C according to an embodiment.

FIGS. 12-17 further illustrate the assembly of the reaction chamber 1 relative to the manifold 3, according to embodiments. As seen in FIG. 12, the reaction chamber housing 61 of the reaction chamber 1 receives the composition 23 and filter 25. The gasket 47 and manifold 3 are then placed over top of the housing 61 and secured by screws 66. The dimensions of the housing 61 are not particularly limited. It will be understood that these dimensions are variable and dependent upon the needs and demands of the user and the environment in which the apparatus is used As seen in FIG. 13, the reaction chamber housing 61 of the reaction chamber 1 receives the partition 31, scrubbing composition 24 and filter 28. The bottom cover 29 is then placed over the bottom of the housing 61 and secured by screws 66. FIG. 14 illustrates the reaction chamber housing 61 configured with the partition 31 and the one or more apertures 32. FIG. 15A illustrates the reaction chamber housing 61 configured with the partition 31, the one or more apertures 32 and the mesh screen 62. FIG. 15B shows the bottom cover 29 secured to the housing 61. FIG. 16 illustrates the bottom cover 29 secured to the housing 61 via joint 63. FIG. 17 shows the gasket 47 secured to the housing 61.

Figure 18:
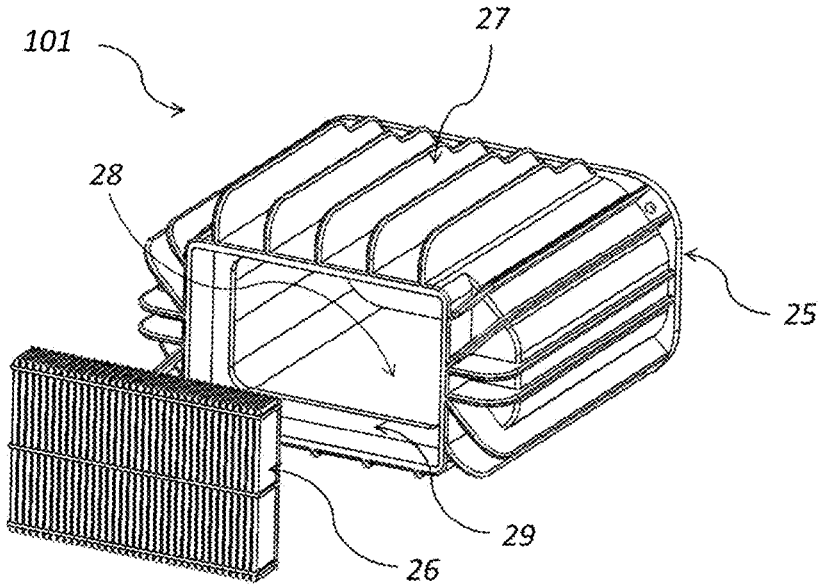
FIG. 18 is a perspective exploded view of a reaction chamber according to another embodiment including fins and a filter.

FIG. 18 illustrates another embodiment of the reaction chamber. The composition of the material making up the reaction chamber 101 is similar to the first embodiment of the reaction chamber 1. In this embodiment, a series of fins 27 may surround the reaction chamber 101. The fins provide cooling and hold the bladder 6 away from the chamber to allow air to flow unimpeded into the manifold 3 thereby allowing the oxygenated air to flow unimpeded through channels defined by the sidewalls of two adjacent fins and the portion of the outer wall surface between the two fins (bottom) and the bladder (ceiling) into manifold 3. An angle of protrusion formed between a side surface of a fin and an adjacent outer wall surface of the reaction chamber 101 is not particularly limited, and may be in a range of 1° to 179°, 15° to 165°, 30° to 150°, 45° to 135°, 60° to 1200, 75° to 105°, or substantially 90°, or 90°. The fins are configured to dissipate heat created by the exothermic chemical reaction (s) inside the container, which can reach temperatures in a range of 100 to 250° C. The chemical composition is installed into the cavity of reaction chamber 101. A filter 26 may be provided to enclose the chemical composition in the reaction chamber 101.

Figure 19:
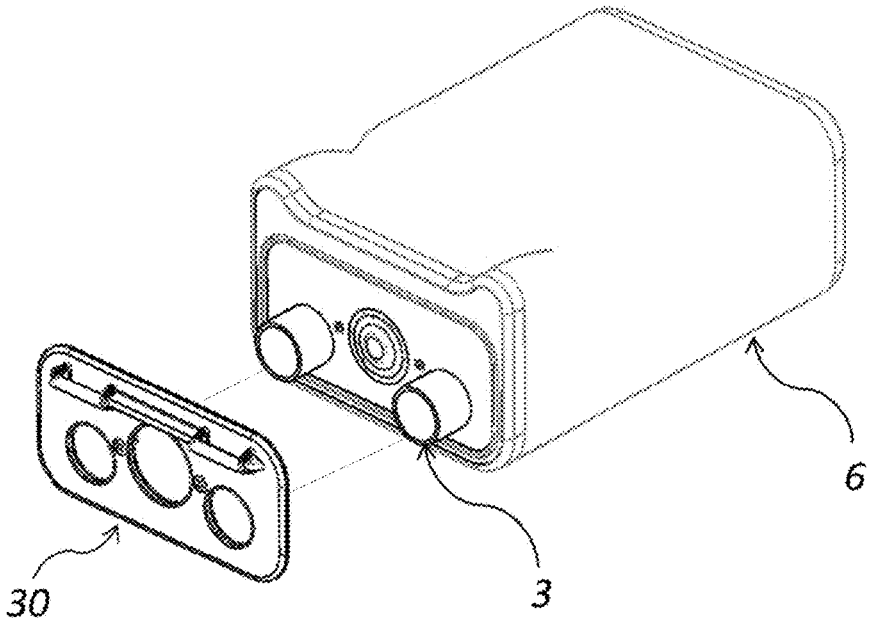
FIG. 19 is a perspective exploded view of a reaction chamber according to another embodiment including a manifold and a bladder.

FIG. 19 illustrates another embodiment of the attachment of the bladder 6 to the manifold 3. In this embodiment, the bladder 6 is sandwiched between the clamp plate 30 and the manifold 3. An O-ring may be used to create an air-tight seal between the bladder 6 and the manifold 3. Alternate embodiments will use adhesives or heat sealing techniques to attach the bladder 6 to the manifold 3. Yet another embodiment may use an O-ring or other packing material to press the bladder 6 into parallel ribs molded into the manifold 3.

Figure 20A:
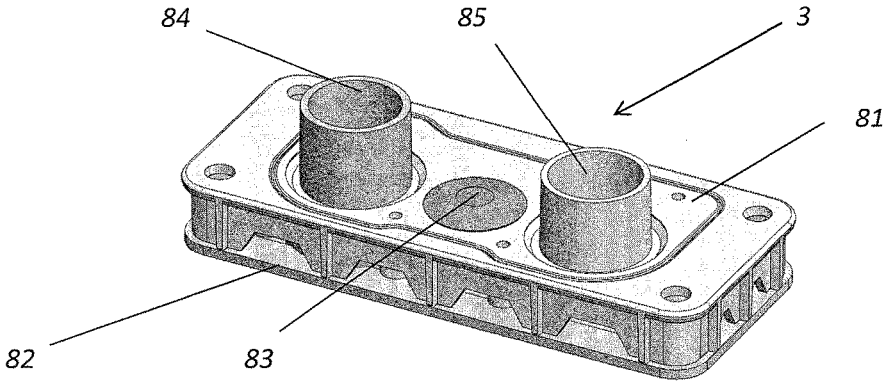
FIG. 20A is a perspective view of a reaction chamber manifold of the oxygen-generating breathing apparatus according to an embodiment.
Figure 20B:
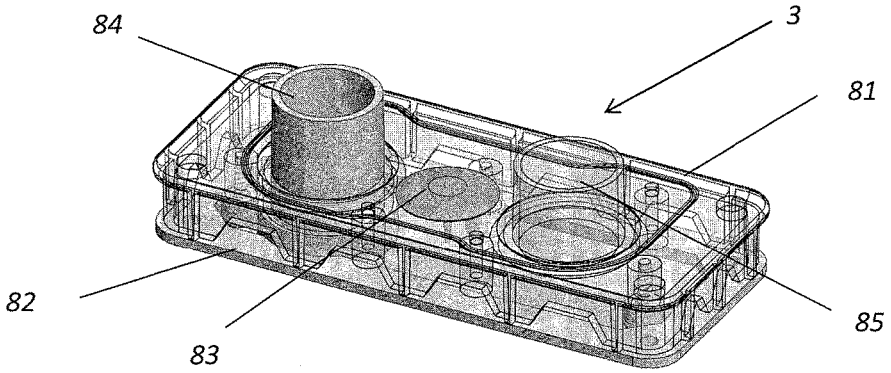
FIG. 20B is a perspective view of the reaction chamber manifold in FIG. 20A illustrating the inside of the manifold.
Figure 20C:
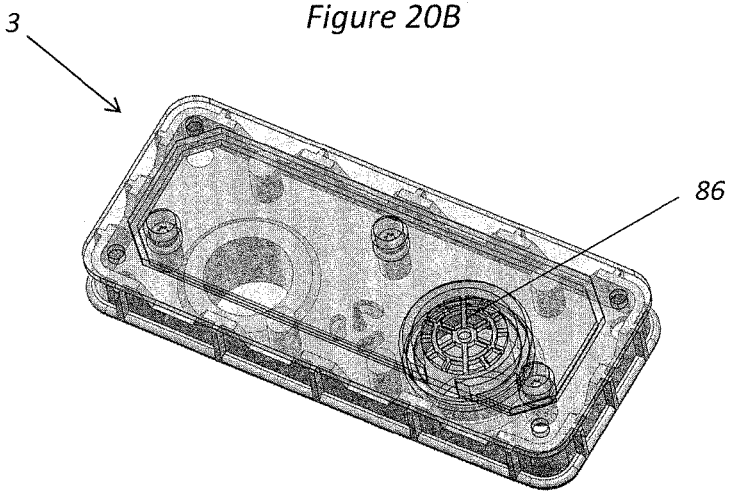
FIG. 20C is a perspective view of the reaction chamber manifold in FIG. 20B illustrating the inside of the manifold from another angle.

FIGS. 20A-23 further illustrate the assembly of the manifold 3 relative to the exhale/inhale tubes 4 and 5, according to embodiments. As seen in FIG. 20A, the manifold 3 may include an upper plate 81 and a lower plate 82. The upper plate 81 includes an inhale port 85 for mating with the inhale tube and an aperture for receiving an exhale port 84 formed on the lower plate 82 when the upper plate 81 and lower plate 82 are fitted together to form the manifold 3. The manifold 3 may also include an overpressure valve 83 for controlling the pressure in the bladder 6, as shown in FIGS. 20A and 20B. As seen in FIG. 20C, the lower plate 82 may also include filter screen 86 molded into the exhale port to filter particles in the exhale gas. FIG. 21A illustrates a top view of the manifold 3 in its constructed configuration. As seen in FIGS. 21B and 21C, the upper plate may further include wall 88 configured to prevent the bladder 6 from blocking or interfering with the ports 84 and 85. The dimensions of the manifold 3 are not particularly limited. It will be understood that these dimensions are variable and dependent upon the needs and demands of the user and the environment in which the apparatus is used.

Figure 23:
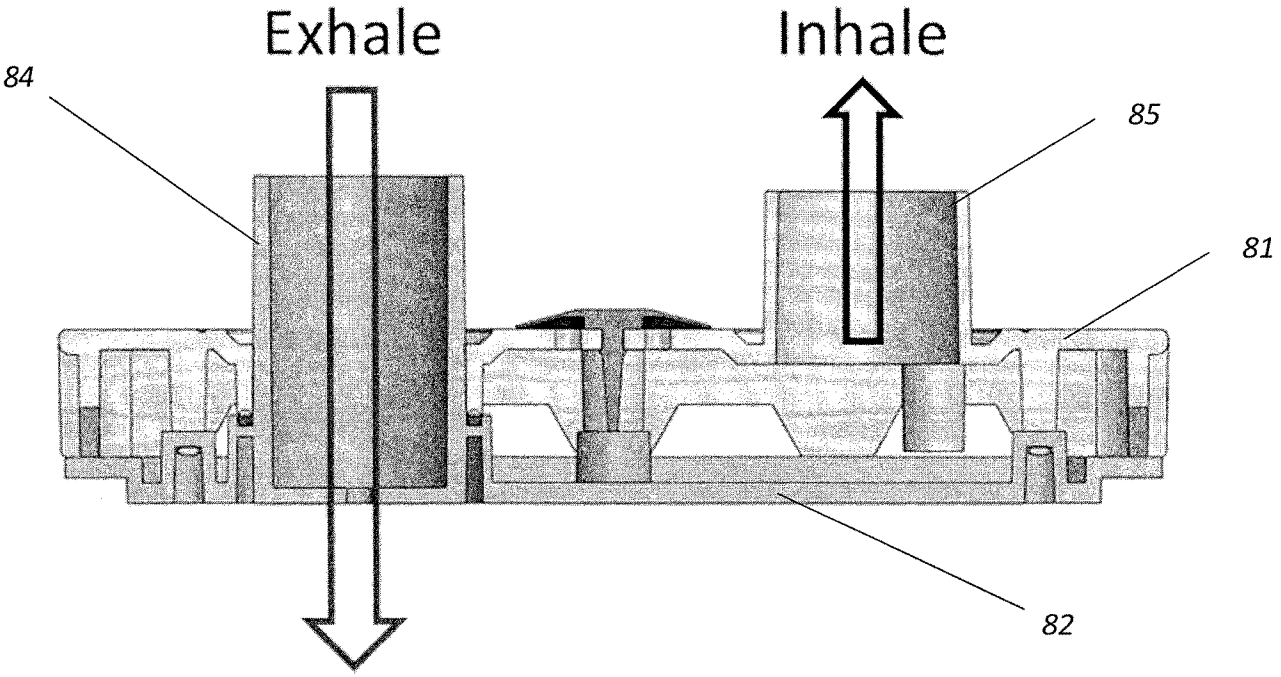
FIG. 23 is a perspective view of the reaction chamber manifold including an o-ring joint and inhale/exhale portions according to an embodiment.

As seen in FIG. 22, in forming the manifold 3, the lower plate 82 receives upper plate 81. An O-ring joint 87 may be placed over the exhale port 84 formed on the lower plate 82 in order to seal the connection between the exhale port 84 and upper plate 81. The overpressure valve 83 may be fitted into a recess formed in the upper plate 81. The upper plate 81 and lower plate 82 may be secured by any suitable means known in the art, including, for example, by screws 66, as shown in FIG. 22. The screws 66 may be, for example, plastite screws, which are light weight and high strength. FIG. 23 illustrates the flow of the exhale and inhale gases through the exhale port 84 and inhale port 85, respectively.

The manifold outer side walls are configured with one or more manifold inhale ports 89. Thus, oxygenated air from the reaction chamber flows into the bladder 6, and from the bladder through inhale ports 89 into a cavity of manifold 3 defined by the interior space between lower plate 82 and upper plate 81. Manifold upper plate 81 has an integrated coupling extension tube that extends from orifice in manifold upper plate 81, which allows oxygenated air to flow from the interior space of the manifold through the coupling extension tube and into inhale tube.

FIGS. 24A-27 further illustrate the assembly of the user interface 10 relative to the interface junction 111. Masks and mouth pieces for use as the user interface 10 are well known in the art, and can be readily adapted for use with the disclosed apparatus. In various other embodiments, a mouth piece may be used in combination with a nose clip, such as a mouthpiece that may be fitted with a removable plug and nose clip. The user interface 10 may include exhale port 184 and inhale port 185 configured to mate with exhale/inhale tubes 4 and 5, as seen in FIG. 24B.

Figure 24A:
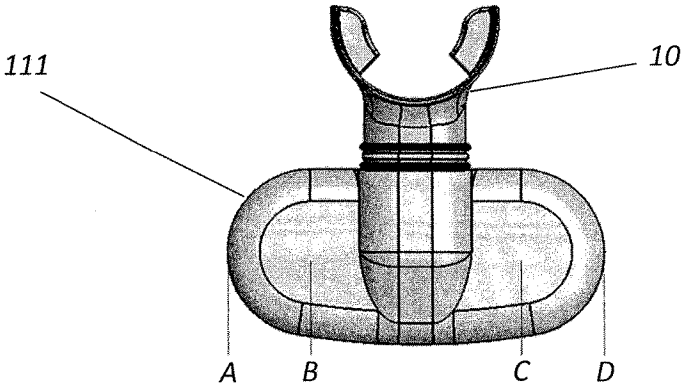
FIG. 24A is a schematic view of mouthpiece and interface junction of the oxygen-generating breathing apparatus according to an embodiment.
Figure 24B:
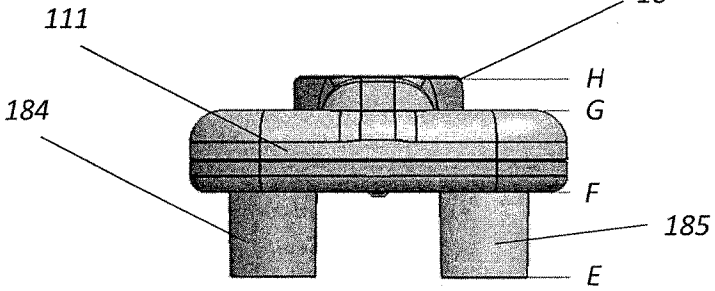
FIG. 24B is a schematic view of the mouthpiece and interface junction in FIG. 24A from another angle.
Figure 24C:
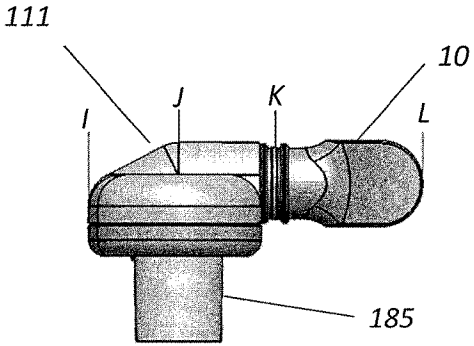
FIG. 24C is a schematic view of the mouthpiece and interface junction in FIG. 24A from another angle.
Figure 25A:
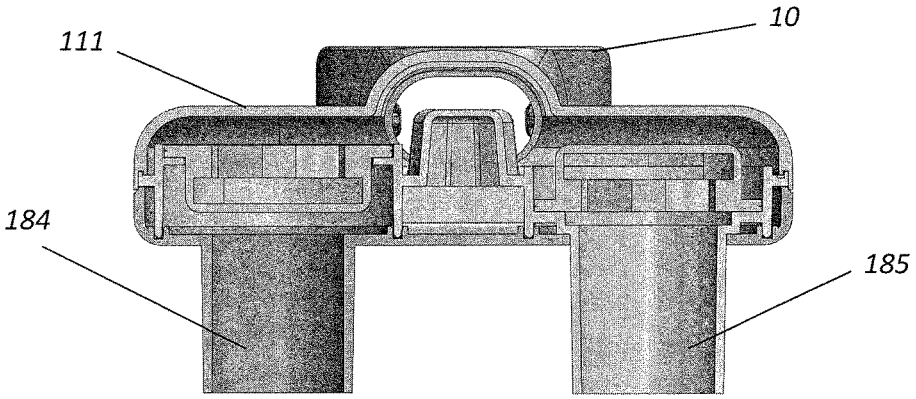
FIG. 25A is a cross-sectional schematic view of the mouthpiece and interface junction in FIG. 24B.
Figure 25B:
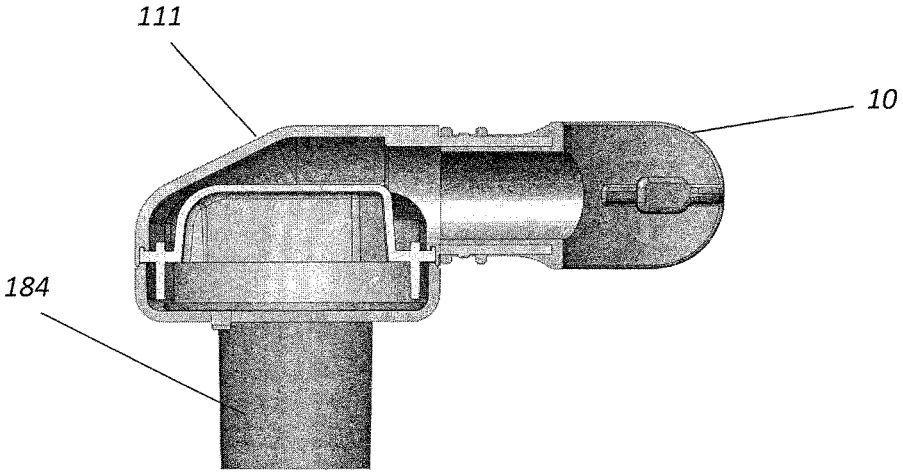
FIG. 25B is a cross-sectional schematic view of the mouthpiece and interface junction in FIG. 24C.

FIGS. 24B and 24C illustrate another embodiment of the interface junction. Interface junction 111 is a T-type interface junction. The user interface 10 may be connected to the interface junction 111 containing an inhale branch that is connected to the inhale pathway, an exhale branch that is connected to the exhale pathway, and a user interface port connected to user interface. The user interface 10 may be connected directly to the user interface port of the interface junction 111, which in turn may be connected to the reaction chamber 1 and bladder 6 directly, or by way of intervening tubing and/or fittings, as seen in FIGS. 25A and 25B.

The inhale and exhale valves may be positioned anywhere along the respective inhale and exhale pathways. However, positioning the inhale and exhale valves close to the user interface port of the junction and positioning the junction close to the user interface minimizes the volume of exhaled, carbon dioxide-rich air that can become trapped between the user interface and the exhale valve, which minimizes the mixing of exhaled air with the oxygenated air. Consequently, the oxygenated air inhaled by the use has a lower content of carbon dioxide.

The configuration and design of the oxygen-generating breathing apparatus may be made with these objectives in mind. For example, the distance from A to D in the embodiment of FIG. 24A may be from 3 to 6 inches, 4 to 5 inches, 4.25 to 4.57 inches, or 4.44 inches. The distance from B to C in the embodiment of FIG. 24A may be from 1 to 4 inches, 2 to 3 inches, 2.25 to 2.75 inches, or 2.5 inches. The distance from E to H in the embodiment of FIG. 24B may be from 1 to 4 inches, 2 to 3 inches, 2.25 to 2.75 inches, or 2.34 inches. The distance from F to G in the embodiment of FIG. 24B may be from 0.10 to 3 inches, 0.5 to 2 inches, 0.75 to 1.5 inches, or 0.95 inches. The distance from I to L in the embodiment of FIG. 24C may be from 2 to 6 inches, 3 to 5 inches, 3.5 to 4.5 inches, or 3.95 inches.

In FIG. 24C, the point J corresponds to a center point of the inhale and exhale valves in the interface junction. Point K corresponds to the interface point between the user interface and the interface junction. The distance from J to K in the embodiment of FIG. 24C may be from 0.10 to 2 inches, 0.5 to 1.25 inches, 0.75 to 1.1 inch, or 1 inch.

Figure 26:
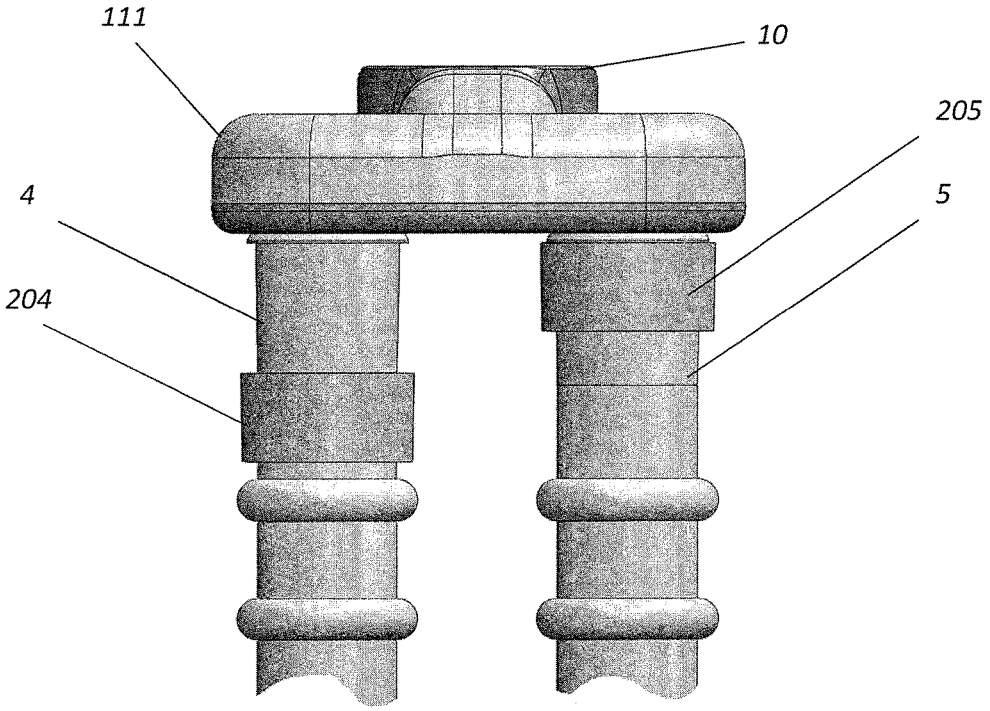
FIG. 26 is a perspective view of the mouthpiece and interface junction including a collar portion according to an embodiment.

The inhale and exhale pathways may each be a single piece, or may be composed of one or more sections of tubing and one or more fittings, as shown in FIG. 26. In FIG. 26, the exhale tube 4 and inhale tube 5 are shown in the formed position respectively connecting to exhale port 184 and inhale port 185 of the interface junction 111. Tubes 4 and 5 may include collars 204 and 205, or a single plate fastened to the interface junction 111 for securely fitting into position. All or part of the inhale and exhale pathways may be flexible or rigid, and each part or component thereof may be made from any suitable material known in the art. For example, the user interface 10 and interface junction 11, 111 may be comprised of similar material to that disclosed above with respect to the reaction chamber 1, 101.

Figure 27:
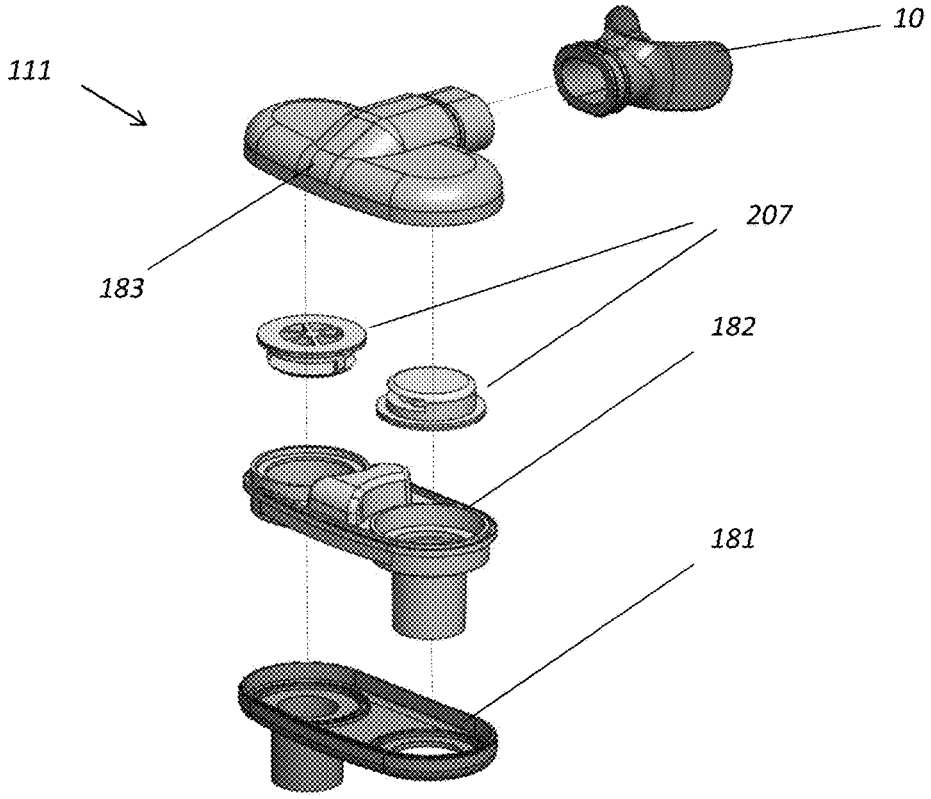
FIG. 27 is a schematic exploded view of an interface junction of the breathing apparatus according to an embodiment.

As shown in FIG. 27, the interface junction 111 may be formed of a bottom plate 181, a middle plate 182, and a top plate 183. The middle plate may include one or more additional valves 207 that filter, control and/or regulate air and/or oxygen flow. For example, the apparatus includes at least a one-way flap valve in either or both of the exhale tube and inhale tube positioned as close as possible to the user interface, as described herein, to regulate air and/or oxygen flow. Other valve designs such as, for example, sliding valves, pressure valves, lever valves, combinations of intake, output, and check valves, and the like are contemplated by this disclosure.

In embodiments, the overall weight of the apparatus 100 including a full reaction chamber is dependent upon the amount of $KO_2$ superoxide composition included in the reaction chamber. For example, the overall weight may be from 0.25 to 15 pounds, 0.5 to 10 pounds, 0.5 to 5 pounds, 1.25 to 4 pounds or 1.5 to 3 pounds. In other embodiments, the apparatus 100 may be configured to be disposable and replaceable. Alternatively, the apparatus may be configured to be re-usable to minimize waste. The apparatus may be optionally configured with one or more indicators applied to the protective cover 7 that indicate change in temperature, storage temperature, usable life and other durability indicators.

In one embodiment, a kit is provided that contains the apparatus along with swimmer's type standard safety goggles and a nose clip to be used to prevent smoke from disturbing the eyes and accidental nasal inhalation. A tubular flexible mouthpiece is included to prevent smoke entering the mouth as well as to permit breathing. Special optional safety goggles with a large flexible underlining to fit over glasses may be included for those who are unable to see clearly without the use of their prescription glasses. In another embodiment, the apparatus is provided with "snorkel type" goggles that isolate the eyes and nose from the environment. Such goggles may be, for example, self-fitting or self-adjusting polymer goggles.

The above-described oxygen generating apparatus offers many benefits over conventional pressurized oxygen generators. For example, the components used in the above-described oxygen generating apparatus are non-hazardous and leak-proof, containing no compressed gas, opening the possibility for use as an emergency breathing apparatus on commercial and private airplanes. Furthermore, for example, the light-weight components and the slowed heat generation of the above-described oxygen generating apparatus allows it to be used for various hand-held or portable uses thereby enabling emergency service personnel to transport the apparatus with them and provide it to victims in need. In particular, the above-described oxygen generating apparatus may be useful as an emergency breathing apparatus for escaping fires and/other hazardous environments, as an oxygen supplement for athletes, including skiers and mountain climbers, and as a treatment device for various health conditions, including asthma, emphysema, and altitude sickness. The oxygen generating apparatus according to embodiments is particularly useful for emergency first responders that cannot use devices including compressed oxygen in fires that involve chemicals. Still further, the above-described oxygen generating apparatus offers the advantage of being light-weight, disposable, and replaceable. Disclosed embodiments have specific benefits over conventional chemical generators with a single tube, because they do not require oxygen candles which are complex, expensive and dangerous. Single tube respirators require oxygen candles. Disclosed embodiments of the interface junction for directing one-direction airflow overcome this need.

It will be appreciated that the above-disclosed features and functions, or alternatives thereof, may be desirably combined into different systems or methods. Also, various alternatives, modifications, variations or improvements may be subsequently made by those skilled in the art, and are also intended to be encompassed by this disclosure. As such, various changes may be made without departing from the spirit and scope of this disclosure.

What is claimed is:

1. A portable oxygen-generating breathing apparatus comprising:

a user interface configured to receive an exhalation air stream from and supply a breathable inhalation air stream to a user;

a reaction chamber configured to house a reaction composition that reacts with the exhalation air stream in order to convert the exhalation air stream into the breathable inhalation air stream;

an inflatable member in fluid communication with the reaction chamber and configured to receive the breathable inhalation air stream from the reaction chamber; and an interface junction disposed between the user interface and the reaction chamber in a flow direction of the exhalation air stream and between the inflatable member and the user interface in a flow direction of the breathable inhalation air stream, the interface junction including (i) an exhale tube having an exhale valve configured to control a flow of the exhalation air stream one-directionally from the user interface to the reaction chamber and (ii) an inhale tube having an inhale valve configured to control a flow of the breathable inhalation air stream one-directionally from the inflatable member to the user interface, the exhale tube and the inhale tube being of substantially the same length extending from the user interface to the reaction chamber and from the inflatable member to the user interface, respectively, wherein the apparatus is configured to be primed by the exhalation air stream, and the inflatable member is disposed around and encloses the reaction chamber in an airtight seal.

2. The portable oxygen-generating breathing apparatus according to claim 1, further comprising a manifold disposed between the interface junction and the reaction chamber, and in communication with the inflatable member, wherein the manifold is configured to separate the flow of the exhalation air stream between the interface junction and the reaction chamber and the flow of the inhalation air stream between the inflatable member and the interface junction.

3. The portable oxygen-generating breathing apparatus according to claim 1, wherein the inflatable member is configured to expand and contract in response to the exhalation air stream and the breathable inhalation air stream.

4. The portable oxygen-generating breathing apparatus according to claim 1, wherein a center of the exhale valve is arranged at a distance in a range of 0.10 to 2 inches from a connection point of the user interface and the interface junction in a direction of the flow of the exhalation air stream.

5. The portable oxygen-generating breathing apparatus according to claim 1, wherein a center of the inhale valve is arranged at a distance in a range of 0.10 to 2 inches from a connection point of the user interface and the interface junction in a direction of the flow of the inhalation air stream.

6. The portable oxygen-generating breathing apparatus according to claim 1, wherein the reaction composition reacts with $CO_2$ in the exhalation air stream to produce $O_2$.

7. The portable oxygen-generating breathing apparatus according to claim 1, wherein the reaction composition reacts with moisture in the exhalation air stream to produce $O_2$.

8. The portable oxygen-generating breathing apparatus according to claim 1, wherein the reaction composition includes potassium super oxide.

9. The portable oxygen-generating breathing apparatus according to claim 1, wherein the reaction chamber is further configured to house a scrubbing composition that reacts with a component of the exhalation air stream.

10. The portable oxygen-generating breathing apparatus according to claim 9, wherein the component of the exhalation air stream is $CO_2$ and the scrubbing composition removes the $CO_2$ from the exhalation air stream.

11. The portable oxygen-generating breathing apparatus according to claim 9, wherein the reaction chamber includes a partition for porously separating the reaction composition from the scrubbing composition.

12. The portable oxygen-generating breathing apparatus according to claim 1, wherein a total weight of the apparatus is in a range of 0.5 to 10 pounds.

13. The portable oxygen-generating breathing apparatus according to claim 1, wherein the user interface is formed of a material selected from the group consisting of light metals, nanocomposites and polymer materials.

14. The portable oxygen-generating breathing apparatus according to claim 1, wherein the reaction chamber is formed of a material selected from the group consisting of light metals, nanocomposites and polymer materials.

15. The portable oxygen-generating breathing apparatus according to claim 1, wherein the interface junction is formed of a material selected from the group consisting of light metals, nanocomposites and polymer materials.

16. The portable oxygen-generating breathing apparatus according to claim 1, wherein the inflatable member is formed of a plastic material.

17. The portable oxygen-generating breathing apparatus according to claim 1, wherein the interface junction is selected from the group consisting of a Y-junction and a T-junction.

18. The portable oxygen-generating breathing apparatus according to claim 1, wherein the reaction chamber includes a plurality of side projections configured to hold the inflatable member away from an inside of the reaction chamber in a radial direction.

19. The portable oxygen-generating breathing apparatus according to claim 1, further comprising a protective covering configured to enclose the inflatable member in order to protect the inflatable member.

20. The portable oxygen-generating breathing apparatus according to claim 19, wherein the protective covering is formed of a material selected from the group consisting of cloth, light metals, nanocomposites and polymer materials.

21. The portable oxygen-generating breathing apparatus according to claim 1, wherein the reaction chamber includes a top filter disposed between a top surface of the reaction chamber and the reaction composition in the reaction chamber.

22. The portable oxygen-generating breathing apparatus according to claim 1, wherein the reaction chamber includes a bottom filter disposed between a bottom surface of the reaction chamber and the reaction composition in the reaction chamber.

23. The portable oxygen-generating breathing apparatus according to claim 1, wherein the interface junction is disposed directly on the reaction chamber and in fluid connection with the inflatable member.

24. The portable oxygen-generating breathing apparatus according to claim 1, wherein the reaction composition includes at least one of a catalyst, adjuvant, and an initiator.

25. The portable oxygen-generating breathing apparatus according to claim 1, wherein a total weight of the apparatus is in a range of 1.25 to 4 pounds.

26. The portable oxygen-generating breathing apparatus according to claim 1, wherein the exhalation air stream is an initial exhalation air stream and the apparatus is configured to be primed only by the initial exhalation air stream.

27. The portable oxygen-generating breathing apparatus according to claim 1, wherein the reaction chamber is formed of a high temperature-resistant polymer material.

28. The portable oxygen-generating breathing apparatus according to claim 27, wherein the high temperature-resistant polymer is selected from the group consisting of perfluoroelastomers, polymers including aromatic cycles or heterocycles, polyimides, polybenzoxazoles, polybenzimidazoles, and polybenzthiazoles.

29. The portable oxygen-generating breathing apparatus according to claim 1, wherein the reaction chamber is formed of a thermoplastic elastomer.

30. The portable oxygen-generating breathing apparatus according to claim 29, wherein the thermoplastic elastomer is selected from the group consisting of styrenic block copolymers, thermoplastic olefins, elastomeric alloys, thermoplastic polyurethanes, thermoplastic copolyester, and thermoplastic polyamides.

31. The portable oxygen-generating breathing apparatus according to claim 1, further comprising fins disposed on the reaction chamber, the fins configured to (i) provide a gap between the reaction chamber and the inflatable member in order to allow heat to dissipate from the reaction chamber, and (ii) directly contact the inflatable member.

32. The portable oxygen-generating breathing apparatus according to claim 1, wherein the reaction chamber includes a steel tube containing a sodium-potassium eutectic alloy, the steel tube configured to absorb heat generated during an exothermic reaction in the reaction chamber.

33. A method of generating oxygen in a portable breathing apparatus, the method comprising:

receiving an exhalation air stream from and providing a breathable inhalation air stream to a user via a user interface;

converting the exhalation air stream into the breathable inhalation air stream in a reaction chamber configured to house a reaction composition that reacts with the exhalation air stream in order to convert the exhalation air stream into the breathable inhalation air stream;

controlling a flow of the exhalation air stream one-directionally from the user interface to the reaction chamber with an interface junction including an exhale tube having an exhale valve disposed between the user interface and the reaction chamber; and controlling a flow of the inhalation air stream one-directionally from an inflatable member in communication with the reaction chamber to the user interface with the interface junction further including an inhale tube having an inhale valve disposed between the inflatable member and the user interface, wherein the exhale tube and the inhale tube are of substantially the same length extending from the user interface to the reaction chamber and from the inflatable member to the user interface, respectively, the exhalation air stream primes the apparatus, and the inflatable member is disposed around and encloses the reaction chamber in an airtight seal.

34. The method of generating oxygen in a portable breathing apparatus according to claim 33, wherein a center of the exhale valve is arranged at distance in a range of 0.10 to 2 inches from a connection point of the user interface and the interface junction in a direction of a flow of the exhalation air stream.

35. The method of generating oxygen in a portable breathing apparatus according to claim 33, wherein a center of the inhale valve is arranged at distance in a range of 0.10 to 2 inches from a connection point of the user interface and the interface junction in a direction of the flow of the inhalation air stream.

* * * * *